US008291524B2

(12) United States Patent
Leonard et al.

(10) Patent No.: US 8,291,524 B2
(45) Date of Patent: Oct. 23, 2012

(54) CLIP FOR MOUNTING A FLUID DELIVERY DEVICE

(75) Inventors: Stephen B. Leonard, Franksville, WI (US); Allen D. Miller, Racine, WI (US); Michael M. Sawalski, Racine, WI (US); Timothy R. Ordiway, Racine, WI (US); Linda M. Madore, Vernon Hills, IL (US); Jeffrey L. Crull, McFarland, WI (US); Steven Merrill Harrington, Cardiff, CA (US); Wai Yin Shum, Caribbean Coast (HK)

(73) Assignee: S.C, Johnson & Son, Inc., Racine, WI (US)

( * ) Notice: Subject to any disclaimer, the term of this patent is extended or adjusted under 35 U.S.C. 154(b) by 1428 days.

(21) Appl. No.: 11/831,653

(22) Filed: Jul. 31, 2007

(65) Prior Publication Data

US 2008/0017762 A1 Jan. 24, 2008

Related U.S. Application Data

(63) Continuation-in-part of application No. 11/800,488, filed on May 4, 2007, now abandoned.

(51) Int. Cl.
*E03D 9/02* (2006.01)

(52) U.S. Cl. ..... 4/231

(58) Field of Classification Search ..... 4/233, 223, 4/231, 420.4, 448; 239/247, 246
See application file for complete search history.

(56) References Cited

U.S. PATENT DOCUMENTS

| | | | | |
|---|---|---|---|---|
| 1,366,426 | A | 1/1921 | Silvers | |
| 2,075,266 | A | 3/1937 | Bowman | |
| 2,166,772 | A | 7/1939 | Salsas-Serra | |
| 2,397,677 | A | 4/1946 | MacGlashan | |
| 2,444,441 | A * | 7/1948 | Grinham | 4/223 |
| 2,614,265 | A | 10/1952 | Vierra | |
| 2,760,209 | A | 8/1956 | Ewing et al. | |
| 3,088,125 | A | 5/1963 | Southwood | |
| 3,128,018 | A | 4/1964 | Corsette et al. | |
| 3,178,070 | A | 4/1965 | Leland | |
| 3,940,027 | A | 2/1976 | Marterer | |
| 3,946,448 | A | 3/1976 | Sioufy | |
| 3,953,902 | A | 5/1976 | Taylor | |
| 4,072,247 | A | 2/1978 | Yamazaki | |

(Continued)

FOREIGN PATENT DOCUMENTS

DE 29811823 U1 10/1999

(Continued)

OTHER PUBLICATIONS

PCT/US2008/005643 International Search Report and Written Opinion dated Aug. 25, 2008.
Non-Final Office Action mailed Aug. 12, 2011 in the parent U.S. Appl. No. 11/800,488.
English Language Abstract of JP 1-97423, Apr. 14, 1989.
English Language Machine Translation of JP 2002-180518, Jun. 26, 2002.
English Language Machine Translation of JP 2005-344300, Dec. 15, 2005.

(Continued)

*Primary Examiner* — Lori Baker

(57) ABSTRACT

A clip for mounting a fluid delivery device adjacent a wall of an enclosure is disclosed. In one embodiment, the device includes a base, a hook configured to support the base adjacent the wall, means for attaching a fluid delivery device to the base, and means for rotating the base. Additionally, a method for attaching a clip for mounting a fluid delivery device adjacent a toilet bowl is disclosed. The method includes securing a hook to a rim, engaging a tab of a base to an underside of the rim at an interface, and rotating the base in response to the interface to substantially engage the tab of the base with the underside of the rim.

19 Claims, 16 Drawing Sheets

U.S. PATENT DOCUMENTS

| | | | | |
|---|---|---|---|---|
| 4,183,105 | A | | 1/1980 | Womack |
| 4,273,257 | A | | 6/1981 | Smith et al. |
| 4,407,217 | A | | 10/1983 | Jackson |
| 4,530,108 | A | * | 7/1985 | Wilmsmeyer ..... 377/111 |
| RE32,017 | E | | 11/1985 | Hautmann et al. |
| 4,560,108 | A | | 12/1985 | Rubinstein |
| 4,562,867 | A | | 1/1986 | Stouffer |
| 4,618,077 | A | | 10/1986 | Corsette |
| 4,660,765 | A | | 4/1987 | Rosenberg |
| 4,670,916 | A | | 6/1987 | Bloom |
| 4,747,523 | A | | 5/1988 | Dobbs |
| 4,763,839 | A | | 8/1988 | Greenberg |
| 4,777,670 | A | | 10/1988 | Klinkhammer et al. |
| 4,817,869 | A | | 4/1989 | Rubinstein |
| 4,873,729 | A | | 10/1989 | Micallef |
| 4,905,903 | A | * | 3/1990 | Katzer et al. ..... 239/246 |
| 5,022,098 | A | | 6/1991 | Brower |
| 5,123,124 | A | | 6/1992 | Brower |
| 5,143,293 | A | | 9/1992 | Pairis |
| 5,203,506 | A | | 4/1993 | Gross et al. |
| 5,347,661 | A | | 9/1994 | Fly et al. |
| 5,457,822 | A | | 10/1995 | Klammsteiner |
| 5,862,532 | A | * | 1/1999 | Cain ..... 4/228.1 |
| 5,906,298 | A | | 5/1999 | Ward |
| 6,000,067 | A | * | 12/1999 | Cascia ..... 4/223 |
| 6,015,067 | A | | 1/2000 | Lang et al. |
| 6,016,972 | A | | 1/2000 | Kantor et al. |
| 6,029,286 | A | | 2/2000 | Funk |
| 6,162,371 | A | | 12/2000 | Rees et al. |
| 6,178,563 | B1 | | 1/2001 | Helfet |
| 6,178,564 | B1 | | 1/2001 | Leonard et al. |
| 6,230,334 | B1 | | 5/2001 | Camp et al. |
| 6,279,174 | B1 | | 8/2001 | Candusso |
| 6,347,414 | B2 | | 2/2002 | Contadini et al. |
| 6,394,310 | B1 | | 5/2002 | Muderlak et al. |
| 6,425,406 | B1 | | 7/2002 | Klinkhammer et al. |
| 6,471,974 | B1 | | 10/2002 | Rees et al. |
| 6,494,384 | B1 | | 12/2002 | Meyer |
| 6,505,356 | B1 | | 1/2003 | Leonard et al. |
| 6,588,026 | B2 | | 7/2003 | Meier et al. |
| 6,651,261 | B1 | | 11/2003 | Leonard et al. |
| 6,675,396 | B2 | | 1/2004 | Varanasi et al. |
| 6,691,329 | B2 | * | 2/2004 | Slade ..... 4/231 |
| 6,694,536 | B1 | | 2/2004 | Haygreen |
| 6,702,157 | B1 | | 3/2004 | Dobbs |
| 6,739,479 | B2 | | 5/2004 | Contadini et al. |
| 6,769,580 | B2 | | 8/2004 | Muderlak et al. |
| 6,772,450 | B1 | * | 8/2004 | Saylor et al. ..... 4/223 |
| 6,812,196 | B2 | | 11/2004 | Rees et al. |
| 6,820,821 | B2 | | 11/2004 | Linstedt et al. |
| 6,898,806 | B2 | | 5/2005 | Keramidas |
| 6,932,279 | B2 | | 8/2005 | Burcham |
| 6,944,890 | B1 | | 9/2005 | Sim |
| 6,971,549 | B2 | | 12/2005 | Leifheit et al. |
| 6,976,277 | B2 | | 12/2005 | Keramidas |
| 7,007,312 | B1 | | 3/2006 | Sim |
| 7,021,494 | B2 | | 4/2006 | Mazooji et al. |
| 7,114,199 | B2 | | 10/2006 | Conway et al. |
| 7,143,957 | B2 | | 12/2006 | Nelson |
| 7,603,726 | B2 | * | 10/2009 | Sawalski et al. ..... 4/223 |
| 2002/0130146 | A1 | | 9/2002 | Borut et al. |
| 2002/0148908 | A1 | | 10/2002 | Linstedt et al. |
| 2003/0056587 | A1 | | 3/2003 | Carpenter et al. |
| 2003/0188377 | A1 | | 10/2003 | Contadini et al. |
| 2004/0050959 | A1 | | 3/2004 | Mazooji et al. |
| 2005/0005378 | A1 | | 1/2005 | Soller et al. |
| 2005/0133540 | A1 | | 6/2005 | Hornsby et al. |
| 2006/0006253 | A1 | | 1/2006 | Nelson |
| 2007/0000941 | A1 | | 1/2007 | Hadden et al. |
| 2007/0040045 | A1 | | 2/2007 | Cohen |
| 2007/0045337 | A1 | | 3/2007 | Hornsby et al. |
| 2007/0136937 | A1 | | 6/2007 | Sawalski et al. |
| 2007/0158359 | A1 | | 7/2007 | Rodrian |
| 2007/0187427 | A1 | | 8/2007 | Shaw et al. |
| 2007/0204387 | A1 | | 9/2007 | Cornelius et al. |
| 2007/0204388 | A1 | | 9/2007 | Zyskowski et al. |
| 2007/0204389 | A1 | | 9/2007 | Graefe et al. |
| 2007/0240251 | A1 | | 10/2007 | Pagani |
| 2007/0240252 | A1 | | 10/2007 | Leonard et al. |
| 2007/0245470 | A1 | | 10/2007 | Nguyen et al. |
| 2007/0289054 | A1 | | 12/2007 | Han et al. |
| 2008/0078780 | A1 | | 4/2008 | Sanger et al. |

FOREIGN PATENT DOCUMENTS

| | | | |
|---|---|---|---|
| EP | 0 274 785 | A1 | 7/1988 |
| EP | 1449969 | A | 8/2004 |
| FR | 2588742 | A | 2/1987 |
| FR | 2850407 | A | 7/2004 |
| FR | 2874038 | | 2/2006 |
| GB | 1.140.900 | A | 2/1969 |
| JP | 1-97423 | | 4/1989 |
| JP | 3-9714 | | 1/1991 |
| JP | 3-228718 | | 1/1991 |
| JP | 5-222757 | | 8/1993 |
| JP | 6-170286 | | 6/1994 |
| JP | 2000-166818 | A | 2/2000 |
| JP | 2000-70797 | A | 3/2000 |
| JP | 2002-04884 | | 2/2002 |
| JP | 2002-180518 | | 6/2002 |
| JP | 2002-286833 | | 10/2002 |
| JP | 2004-100212 | | 4/2004 |
| JP | 2004-283811 | | 10/2004 |
| JP | 2005-36511 | | 2/2005 |
| JP | 2005-46769 | | 2/2005 |
| JP | 2005-52754 | | 3/2005 |
| JP | 2005-103367 | | 4/2005 |
| JP | 2005-211164 | | 8/2005 |
| JP | 2005-344300 | | 12/2005 |
| WO | WO 99/66139 | A1 | 12/1999 |
| WO | WO 99/66140 | A1 | 12/1999 |
| WO | WO 01/14652 | A1 | 3/2001 |
| WO | WO 01/44591 | A1 | 6/2001 |
| WO | WO 2005/070474 | A1 | 8/2005 |
| WO | WO 2006/013321 | A1 | 2/2006 |
| WO | 2008044201 | | 4/2008 |
| WO | 2008076346 | | 6/2008 |

OTHER PUBLICATIONS

English Language Machine Translation of JP 2004-100212, Apr. 2, 2004.

English Language Machine Translation of JP 2002-286833, Oct. 3, 2002.

English Language Machine Translation of JP 2005-36511, Feb. 10, 2005.

English Language Machine Translation of JP 2005-211164, Aug. 11, 2005.

English Language Machine Translation of JP 2005-103367, Apr. 21, 2005.

English Language Machine Translation of JP 2005-52754, Mar. 3, 2005.

English Language Machine Translation of JP 2005-46769, Feb. 24, 2005.

English Language Machine Translation of JP 2004-283811, Oct. 14, 2004.

English Language Translation of JP 2000-70797, Mar. 7, 2000.

English Language Translation of JP 6-170286, Jun. 21, 1994.

English Language Machine Translation of JP 5-222757, Aug. 31, 1993.

English Language Machine Translation of JP 2002-048884, Feb. 15, 2002.

English Language Abstract of JP 3-9714, Jan. 17, 1991.

English Language Abstract of JP 3-228718, Oct. 9, 1991.

English Language Abstract of FR 2874038, May 8, 2004.

English Language Machine Translation of JP 2000-166818, Jun. 20, 2000.

Microsprinkler shown at www.dripirrigation.com, 3 pages, May 3, 2007.

English Language Abstract of FR 2588742, Apr. 24, 1987.

* cited by examiner

CLIP FOR MOUNTING A FLUID DELIVERY DEVICE

CROSS-REFERENCES TO RELATED APPLICATIONS

This application is a continuation-in-part of U.S. patent application Ser. No. 11/800,488 filed May 4, 2007 now abandoned.

STATEMENT REGARDING FEDERALLY SPONSORED RESEARCH

Not Applicable.

BACKGROUND OF THE INVENTION

1. Field of the Invention

This invention relates to a clip for mounting a fluid delivery device for spraying a fluid, such as a cleaner or deodorizer, on the inside surfaces of an enclosure, such as a toilet bowl, a shower enclosure, or a bathtub enclosure, where the body of the clip can be rotatably adjusted relative to the hook of the clip to direct dispensed fluid to the inside surfaces of the enclosure.

2. Description of the Related Art

Toilet bowls require care to prevent the buildup of unsightly deposits, to reduce odors, and to prevent bacteria growth. Traditionally, toilet bowls have been cleaned, deodorized, and disinfected by manual scrubbing with a liquid or powdered cleaning and sanitizing agent. This task has required manual labor to keep the toilet bowl clean.

In order to eliminate the detested manual scrubbing, various toilet bowl cleaner dispensers have been proposed. One type of dispenser comprises a solid block or solid particles of a cleansing and freshening substance that is suspended from the rim of a toilet bowl in a container that is placed in the path of the flushing water. U.S. Pat. No. 4,777,670 (which is incorporated herein by reference along with all other documents cited herein) shows an example of this type of toilet bowl cleaning system. Typically, a portion of the solid block is dissolved in the flush water with each flush, and the flush water having dissolved product is dispensed into the toilet bowl for cleaning the bowl.

Other toilet bowl cleaning systems use a liquid cleaning agent that is dispensed into a toilet bowl. For example, U.S. Pat. Nos. 6,178,564 and 6,230,334, and PCT International Publication Nos. WO 99/66139 and WO 99/66140 all disclose cleansing and/or freshening devices capable of being suspended from the rim of a toilet bowl for introducing liquid active substances from a bottle into the flushing water with each flush. In these under the toilet rim devices, the liquid active substances are delivered downward from a reservoir to a dispensing plate that is supported by a base that is suspended from the toilet bowl rim. The device is suspended from the toilet rim such that the flow of flush water from the toilet contacts the dispensing plate during a flush. The flush water carries the liquid active substances that are on the dispensing plate into the toilet bowl to clean and freshen the toilet.

Other toilet bowl dispensers use an aerosol deodorizing and/or cleaning agent that is dispensed into a toilet bowl through a conduit attached to the toilet bowl rim. For example, U.S. Pat. No. 3,178,070 discloses an aerosol container mounted by a bracket on a toilet rim with a tube extending over the rim; and U.S. Pat. Nos. 6,029,286 and 5,862,532 disclose dispensers for a toilet bowl including a pressurized reservoir of fluid, a conduit connected to the source of fluid, and a spray nozzle which is installed on the toilet rim.

One disadvantage with these known toilet rim dispensing devices is that these devices may only apply the deodorizing and/or cleaning agent to one location in the toilet water or a limited area in the toilet water or on the inner surface of the toilet bowl. As a result, the cleaning of the inner surface of the toilet bowl may be limited to an area of the toilet bowl near the device.

U.S. Patent Application Publication No. 2007/0136937, which is owned by the owner of the current invention, sets forth, among others, an automatic or manual toilet bowl cleaning device where the inner surface of the toilet bowl is cleaned around the entire circumference of the toilet bowl. In one embodiment illustrated in that application, the downstream end of the conduit terminates in a nozzle capable of spraying the fluid outwardly onto the inner surface of the toilet bowl. The nozzle is attached near the rim of the toilet bowl.

Several techniques are available to provide limited adjustment for devices attached to the rim of a toilet bowl. Adjustment has been generally limited to either (1) accommodating toilet bowl rims of varying width, as shown in U.S. Pat. No. 6,029,286 wherein a ratchet arrangement between two members of the hook is used to adjust the hook for varying rim widths, or (2) attempting to accommodate the depth of the rim and bowl geometry by adjusting the vertical position of the device below the rim. For example, U.S. Pat. No. Re. 32,017 and U.S. Pat. Nos. 6,898,806 and 7,114,199 incorporate a ratchet arrangement between the hook and the body to allow discrete vertical adjustment of the device below the rim of a toilet bowl. Furthermore, U.S. Pat. No. 6,675,396 allows for continuous adjustment of the body with respect to the rim by the use of a friction fit wherein a flat bar hook is wedged within a hollow channel formed within the body.

The previous means of adjustment, however, may not adequately position the nozzle so that the dispensed fluid reaches the extremes of the inner surface of the toilet bowl when the toilet bowl has an asymmetric or elongated rim/inner surface configuration.

Therefore, there is a need for an improved clip for mounting a nozzle near the rim of the toilet bowl.

SUMMARY OF THE INVENTION

The foregoing needs can be met with a clip according to the present invention for mounting a fluid delivery device. The clip is suitable for use in an automated or manual cleaning system for cleaning an enclosure, such as a toilet bowl, a shower enclosure, a bathtub enclosure, and the like. As used herein, the term "cleaning" also includes sanitizing and/or disinfecting, the term "deodorizing" also includes freshening, and the term "fluid" includes cleaning fluids, sanitizing fluids, disinfecting fluids, and the like. Furthermore, the term "fluid" is read broadly to include, liquids, gels, flowable powders, vapors, and the like. Without limitation, an example embodiment of the invention will be described with reference to a toilet bowl.

The clip maintains the security and orientation of the fluid delivery device while in use to help ensure that the fluid is dispensed onto the desired enclosure surfaces. The clip is secured to the enclosure to prevent inadvertent or accidental movement that may cause undesired signals from the sensor and/or alter the coverage of the dispensed fluid. Additionally, the clip accommodates varying toilet sizes and shapes by adjusting for rim height, depth, angle, and curvature. Angle adjustment can be done substantially automatically as the clip is mounted to a rim. Grips on the hook help to ensure the orientation of the clip is maintained once set. Furthermore, channels are present to secure the fluid conduit to the clip to prevent pinching or kinks in the fluid conduit.

The invention provides a clip for mounting a fluid delivery device adjacent a wall of an enclosure. In one embodiment, the clip includes a base, a hook configured to support the base adjacent the wall of an enclosure, means for attaching a fluid delivery device to the base, and a connector rotatably connecting the base and the hook.

In one aspect, the means for attaching a fluid delivery device to the base may comprises an arm extending from the body. Further, the arm may include a support segment and a barrel at the distal end of the support segment for supporting a fluid delivery device.

In another aspect, the base may include a fluid inlet and the clip may include a fluid delivery device including a nozzle in fluid communication with the fluid inlet. The nozzle may include a deflection plate, a passageway in fluid communication with the fluid inlet at an upper end of the passageway and extending between the fluid inlet and the deflection plate, a channel in fluid communication with a lower end of the passageway, and a pair of fins flanking the channel and extending upwardly from the deflection plate that when contacted by fluid rotate the nozzle.

In one configuration, the connector rotatably connecting the base and the hook includes a rib protruding from the hook, a channel formed in the base for receiving the hook, a slit formed in the channel comprising an entrance, an exit, and an intermediate position between the entrance and the exit for receiving the rib. Furthermore, the width of the slit decreases from the entrance to the intermediate position and increases from the intermediate position to the exit to allow relative rotation between the hook and the base about a point located near the intermediate position of the slit. The hook may include ratchet teeth and the channel may comprise one or more protrusions for engaging the ratchet teeth to resist sliding movement between the hook and base.

In another configuration, the connector rotatably connecting the base and the hook includes a rib protruding from the hook, a channel formed in the base for receiving the hook, and a recess formed in the channel for receiving the rib of the hook. The recess includes an entrance, an exit, and an intermediate position between the entrance and the exit. The width of the recess decreases from the entrance to the intermediate position and increases from the intermediate position to the exit to allow relative rotation between the hook and the base about a point located near the intermediate position of the recess. In one version of the connector, the hook can include projections on a surface of the hook opposite the rib, and the base can include at least one arcuate ridge on an inner surface of the base. At least one of the projections on the hook travels in a arcuate path adjacent at least one arcuate ridge when the base is rotated with respect to the hook. In another version of the connector, the hook includes projections on a surface of the hook opposite the rib, and the base includes a plurality of arcuate ridges on an inner surface of the base wherein adjacent arcuate ridges define a channel therebetween. At least one of the projections travels in an arcuate path in the channel when the base is rotated with respect to the hook. In yet another version of the connector, the hook includes domed projections on a surface of the hook opposite the rib, and the base includes a plurality of arcuate ridges on an inner surface of the base. The ridges can have a rounded top surface, and adjacent arcuate ridges can define a concave channel therebetween. At least one of the projections travels in an arcuate path in the concave channel when the base is rotated with respect to the hook. Preferably, the projections are centrally located and linearly aligned on the surface of the hook.

In another aspect, the hook may comprise means for attaching a fluid conduit to the hook. Furthermore, the means for attaching the fluid conduit to the hook may include a channel. In a further aspect, the fluid conduit extends into the fluid inlet for delivering fluid to the fluid delivery device.

In another embodiment of the invention, a clip for mounting a fluid delivery device adjacent a wall of an enclosure includes a base, a hook configured to support the base adjacent the wall, means for attaching a fluid delivery device to the base, and a sensor mounted on the base or the hook. In one aspect, the sensor may be a motion sensor, a proximity sensor, or the like.

In another aspect, the means for attaching a fluid delivery device to the base comprises an arcuate arm extending downwardly from the base to rotatably support a fluid delivery device. In yet a further aspect, the sensor is mounted on the base on a surface opposite of the hook.

In an additional embodiment, a device for spraying an inner surface of an enclosure with a fluid, includes a container for the fluid, a fluid delivery device through which the fluid can be applied to the inner surface of the enclosure, a fluid conduit in fluid communication with the container and the fluid delivery device, means for delivering fluid from the container through the fluid conduit and to the fluid delivery device, and a clip for mounting the fluid delivery device adjacent the inner surface of the enclosure; the clip comprises a base, a hook configured to support the base adjacent the inner surface, and a connector rotatably connecting the base and the hook. In one aspect, the enclosure is one of a tub, a shower, a toilet, or the like.

In a further aspect, the clip comprises a rib protruding from the hook, a channel formed in the base for receiving the hook, a slit formed in the channel comprising an entrance, an exit, and an intermediate position between the entrance and the exit for receiving the rib, and wherein the width of the slit decreases from the entrance to the intermediate position and increases from the intermediate position to the exit to allow relative rotation between the hook and the base about a point located near the intermediate position of the slit.

In another aspect, the connector rotatably connecting the base and the hook includes a rib protruding from the hook, a channel formed in the base for receiving the hook, and a recess formed in the channel for receiving the rib of the hook. The recess includes an entrance, an exit, and an intermediate position between the entrance and the exit. The width of the recess decreases from the entrance to the intermediate position and increases from the intermediate position to the exit to allow relative rotation between the hook and the base about a point located near the intermediate position of the recess.

In yet another aspect, a sensor is mounted on the hook or the base. Furthermore, the sensor may be a motion sensor, a proximity sensor, or the like.

In a further embodiment, a method for attaching a clip for mounting a fluid delivery device adjacent a toilet bowl having a rim including an underside, comprises the steps of providing a base comprising a tab, providing a hook configured to support the base adjacent the rim, providing means for rotating the base, securing the hook to the rim, engaging the tab of the base to the underside of the rim at an interface, and rotating the base in response to the interface to substantially engage the tab of the base with the underside of the rim.

It is therefore an advantage of the invention to provide a clip for mounting a fluid delivery device where the body of the clip is rotatable relative to the hook such that fluid is dispensed onto the inner surface of the enclosure, and further, where a sensor mounted to the hook or base helps prevent dispensing fluid during undesired periods.

These and other features, aspects, and advantages of the present invention will become better understood upon consideration of the following detailed description, drawings, and appended claims.

BRIEF DESCRIPTION OF THE DRAWINGS

Like reference numerals will be used to refer to like parts from Figure to Figure in the following description of the drawings.

DETAILED DESCRIPTION OF THE INVENTION

A clip according to the invention for mounting a fluid delivery device can be used in various devices that dispense fluid onto the inside surfaces of an enclosure, such as a toilet bowl, a shower enclosure, a bathtub enclosure, or the like. Various embodiments of the invention will now be described with reference to the Figures. The embodiments are shown and described for the purposes of illustration and are not intended to limit the invention in any way.

Figure 2:
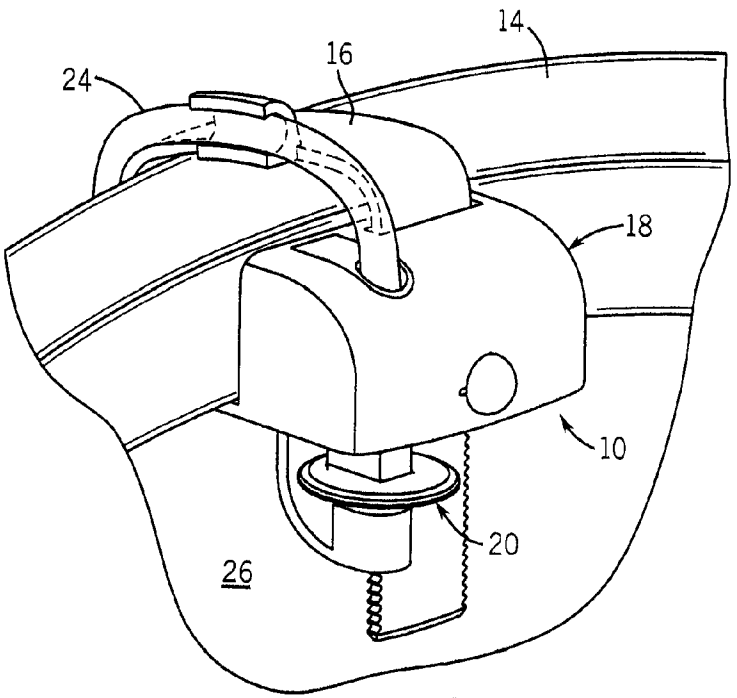
FIG. 2 is a perspective, fragmentary view taken along line 2-2 of FIG. 1 showing the clip of FIG. 1.
Figure 1:
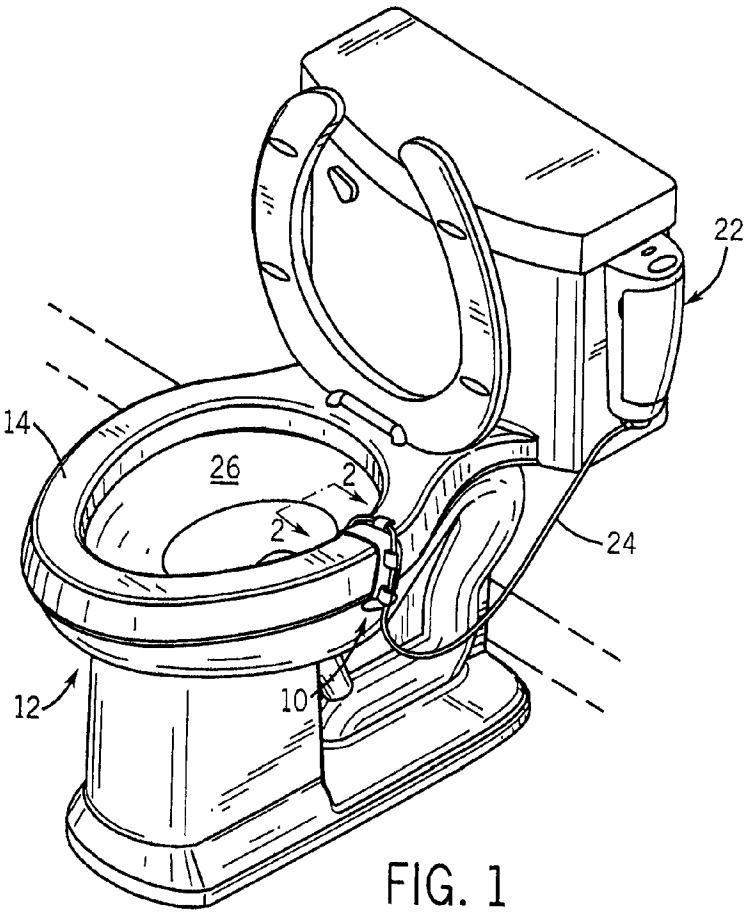
FIG. 1 is a perspective view of an embodiment of a clip for mounting a fluid delivery device in accordance with the invention mounted to a toilet bowl.

Turning to FIGS. 1 and 2, there is shown an example embodiment of a clip 10 for mounting a fluid delivery device to an enclosure, here a toilet bowl 12. The clip 10 is secured to the rim 14 of the toilet bowl 12 by a hook 16. A base 18 is supported by the hook 16 and houses a fluid delivery device, here a nozzle 20. A container 22 supplies fluid via a fluid conduit 24 to the fluid delivery device 20 to be dispensed onto the inside surface 26 of the toilet bowl 12. The fluid can be supplied from the container 22 to the fluid delivery device 20 in a variety of ways; for example, the fluid may be motivated by a gaseous propellant, by a pump, a syringe, or any other suitable means. Furthermore, the execution of the fluid delivery from the container 22 can be controlled by a variety of methods/devices, one being a timing circuit using predetermined logic to control when the fluid is dispensed.

Figure 3:
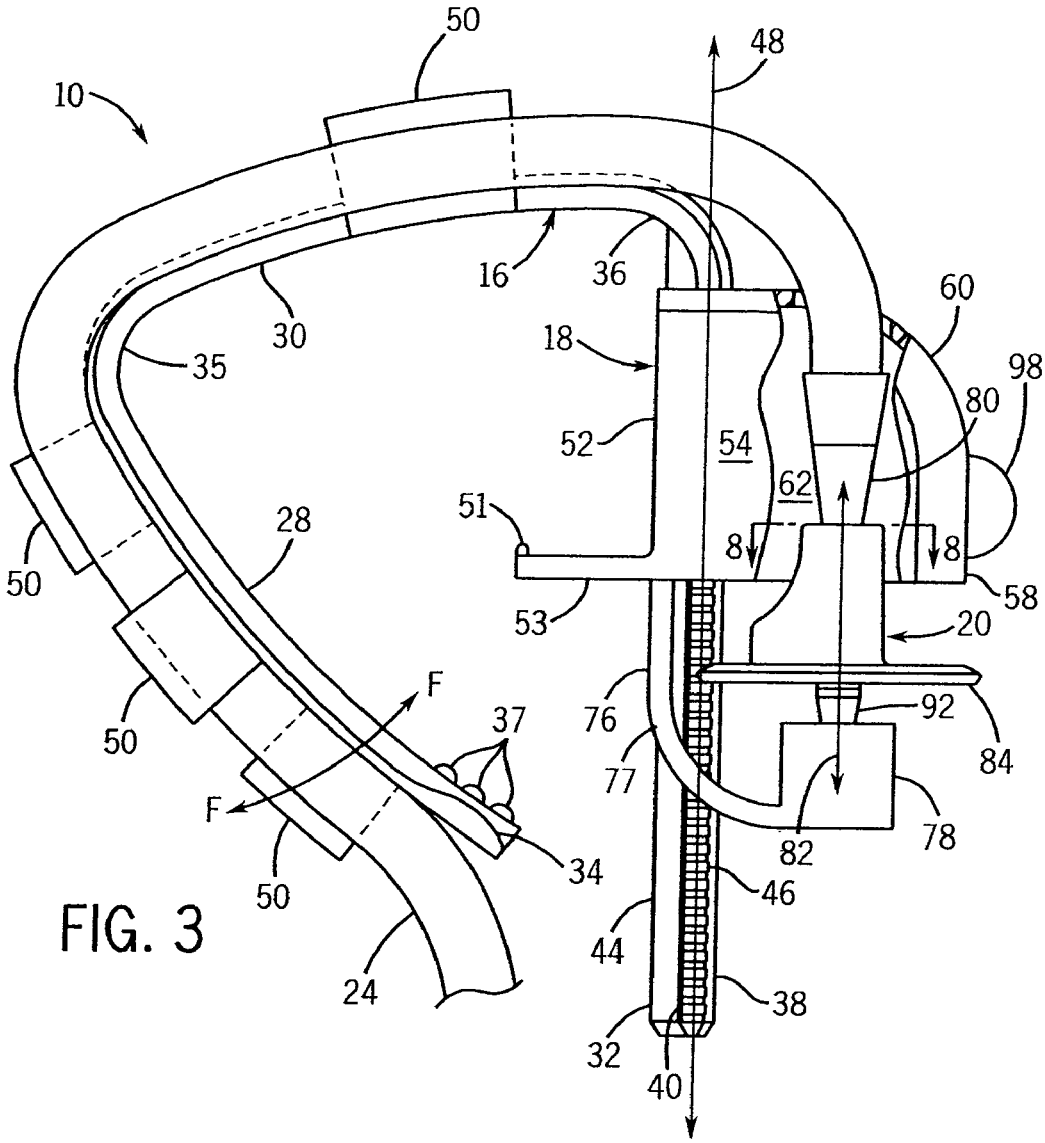
FIG. 3 is a side elevation view having a cutout showing a portion of the interior of the clip of FIG. 1.
Figure 4:
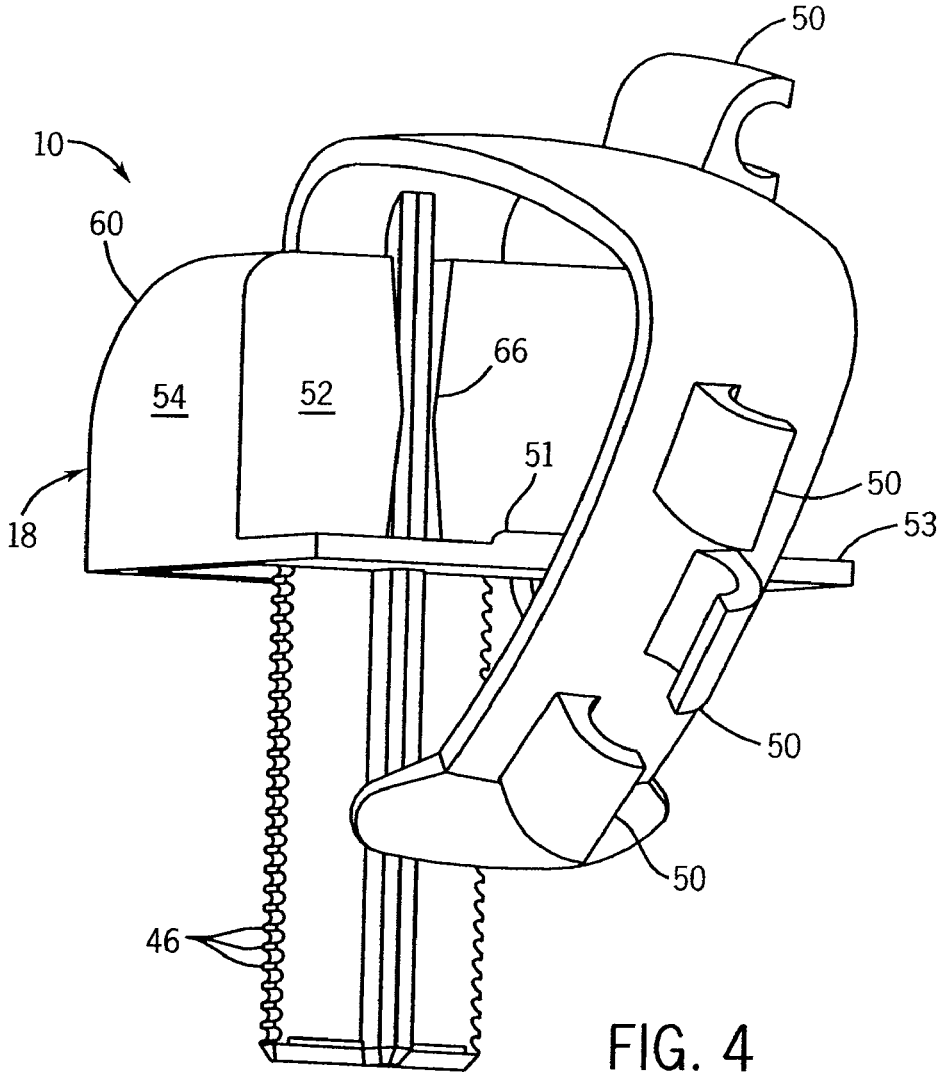
FIG. 4 is a rear oblique view of the clip of FIG. 1.
Figure 5:
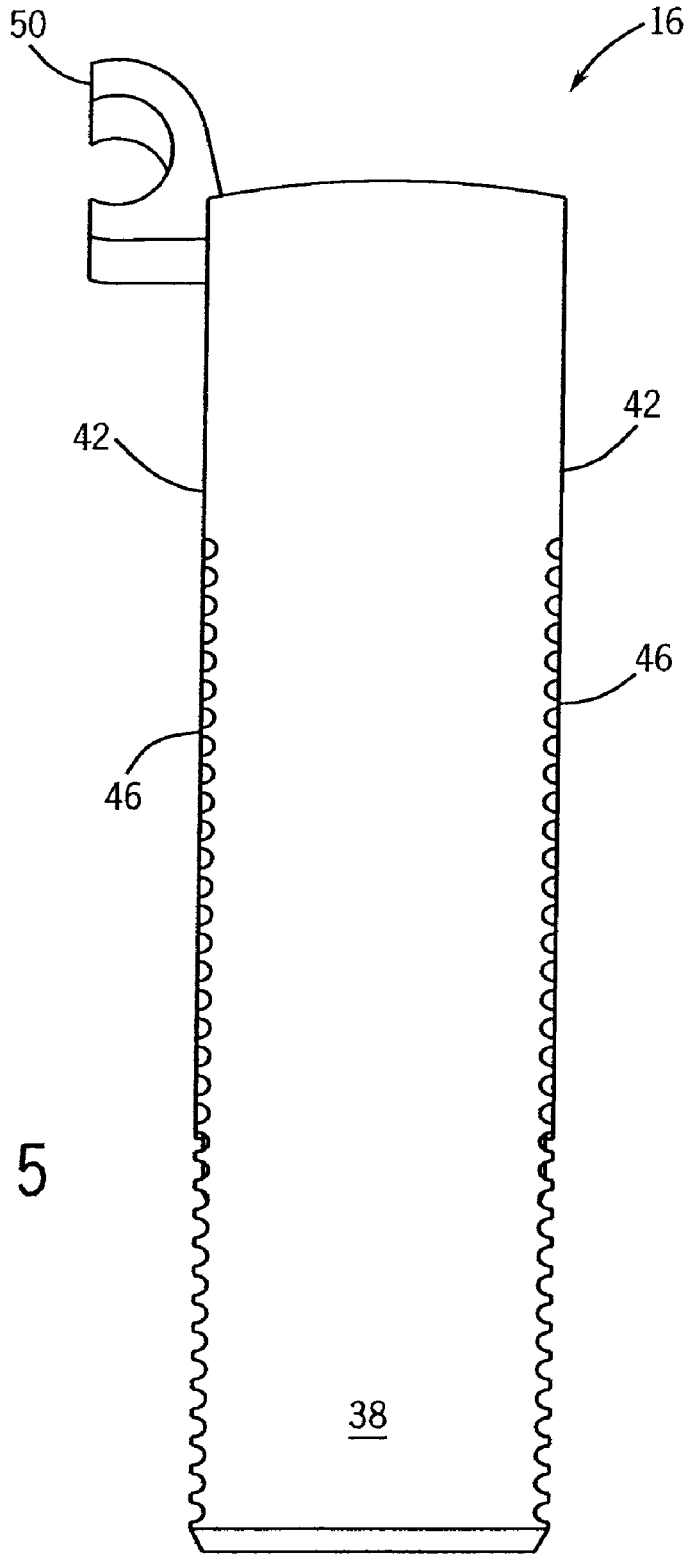
FIG. 5 is a front view of a portion of the clip of FIG. 1 showing a hook of the clip in accordance with an embodiment of the invention.

Turning to FIGS. 3, 4, and 5 the hook 16 for supporting the base 18 and attaching the clip 10 to the toilet bowl 12 has three main segments. A bowl segment 28, a top rim segment 30, and an inner rim segment 32. All three segments 28, 30, 32 are preferably integrally molded from plastic (e.g., polyethylene or polypropylene) and form a flexible hook 16. The bowl segment 28 has a substantially rectangular cross-section and a flared elastomeric gripping foot 34 with elastomeric ribs 37 at a lower end for helping to secure the clip 10 to the toilet bowl 12. Suitable elastomeric materials for the gripping foot 34 and ribs 37 include, without limitation, neoprene, polyurethane rubbers, and silicone rubbers. The bowl segment 28 extends substantially vertically upward and transitions into the top rim segment 30 at a flexible elbow 35 that allows the hook 16 to flex predominantly in the F-F direction (shown on FIG. 3) to secure the clip 10 to toilet bowls of various shapes and sizes. The top rim segment 30 has a substantially rectangular cross-section and extends horizontal across the rim 14 of the toilet bowl 12 where it transitions into the inner rim segment 32 at another flexible elbow 36, also allowing the hook 16 to flex. The inner rim segment 32 extends vertically downward from the elbow 36 and is configured to engage and support the base 18.

The inner rim segment 32 of the hook 16 has a front face 38 and a rear face 40 joined by two short side faces 42. A rib 44 protrudes from the rear face 40 of the inner rim segment 32 and extends the length thereof. As discussed in detail below, the rib 44 limits the angle of rotation of the base 18 with respect to the hook 16. The rib 44 of the example embodiment has a substantially rectangular cross-section, however, the rib 44 may have a curved cross-section, a square cross-section, comprise two spaced apart members, and the like. Additionally, the rib 44 need not extend the length of the inner rim segment 32 provided the rib 44 engages the base 18 throughout the desired adjustable range of the base 18. The short side faces 42 have ratchet teeth 46 used in conjunction with the base 18 to restrain vertical movement of the base 18 along a vertical axis 48. Other restraints may be used, such as a friction fit between the hook 16 and base 18, or the like.

The bowl segment 28 and the top rim segment 30 include a series of C-shaped channels 50 that restrain the conduit 24 as it is routed around the perimeter of the hook 16 on its way to the nozzle 20 in the base 18. The bowl segment 28 of the present embodiment includes three C-shaped channels 50 of alternating openings. The conduit 24 is pressed into the C-shaped channels 50, however, the channels 50 could be rectangular or any other suitable shape to restrain the conduit 24. The top rim segment 30 preferably includes one channel 50 helping to route the conduit 24, however, more may be used if needed.

Figure 6:
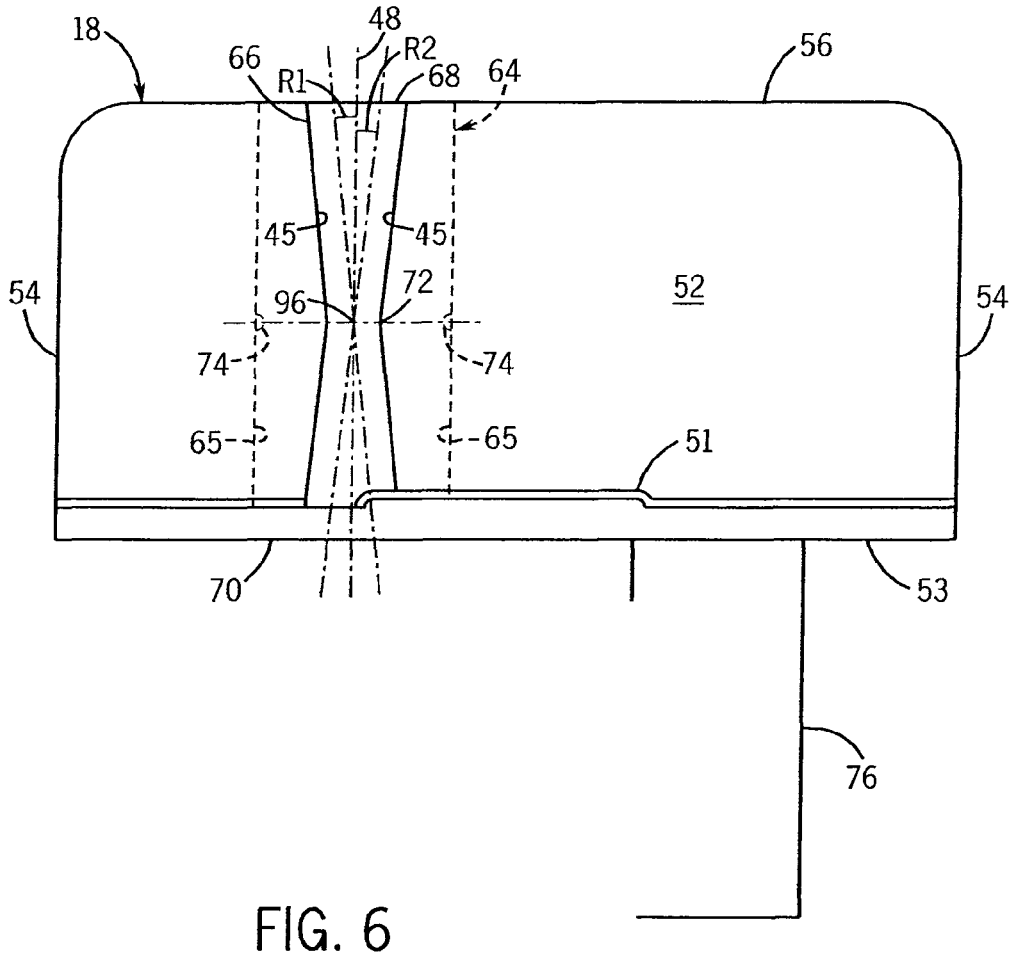
FIG. 6 is a rear view of a portion of the clip of FIG. 1 showing a base of the clip in accordance with an embodiment of the invention.

Turning to FIGS. 3, 4, and 6 the base 18 has a back face 52, a pair of spaced apart side faces 54 extending forward of the back face 52, a top face 56 and a front face 58 extending between the side faces 54, and a curved face 60 extending between the side faces 54, top face 56, and front face 58. The faces 52, 54, 56, 58, 60 define a partial cavity 62 housing a portion of the nozzle 20. The base 18 has a tab 53 that extends rearward from the back face 52 of the base 18. The tab 53 helps orientate the base 18 with respect to the rim 14 when the clip 10 is mounted to the toilet bowl 12, as discussed below. The tab 53 may be one continuous member as shown in the example embodiment, or alternatively, the tab 53 may include a plurality of members extending from the base 18. The base 18 is preferably molded from plastic (e.g., polyethylene or polypropylene).

With emphasis on FIG. 6, the base 18 includes a channel 64 for receiving the inner rim segment 32 of the hook 16. The channel 64 includes a slit 66 for receiving the rib 44 having an entrance 68, an exit 70, and an intermediate position 72 (which may or may not be equidistant from the entrance 68 and the exit 70). The width of the slit 66 decreases from the entrance 68 to the intermediate position 72 and increases from the intermediate position 72 to the exit 70. In one embodiment, the intermediate position 72 is approximately half way between the entrance 68 and the exit 70; however, the narrowest point need not be halfway between the entrance 68 and exit 70, but may occur anywhere between the extremes of the slit 66. Additionally, the maximum width of the slit 66 may vary depending on the desired degree of adjustment of the base 18 with respect to the hook 16. If greater rotational adjustment of the base 18 is desired, the maximum width of the slit 66 at the entrance 68 and exit 70 may be increased; alternatively, or in addition, the width of the rib 44 may be decreased.

The channel 64 includes a pair of projections 74 extending from the walls of the short sides 65 of the channel 64 to engage the ratchet teeth 46 of the hook 16 as the inner rim segment 32 slides within the channel 64. The projections 74 are configured to engage the ratchet teeth 46 to inhibit vertical sliding of the base 18 with respect to the hook 16. The projections 74 may be rounded, terminate in a point, or other suitable geometry. Many other structures are capable of providing the desired restraint, such as a spring-loaded ball that is housed in a cavity formed in the channel 64 to urge the ball against a contour (e.g., ratchet teeth 46) of the channel 64. The engagement between the projections 74 and the ratchet teeth 46 is such that the base 18 is capable of the desired rotation (discussed below) without causing the projections 74 and ratchet teeth 46 to disengage.

The base 18 further includes a means to attach a fluid delivery device (e.g., a nozzle 20). In the example embodiment, the nozzle 20 is restrained laterally between a fluid inlet 80 and a barrel 78. The base 18 includes an arm 76 extending downward from the base 18. The arm 76 has a flat bar support segment 77 with a J-shaped bend extending forward with a barrel 78 located at the distal end of the support segment 77. The barrel 78 includes a tubular recess for receiving the bottom of the nozzle 20. The base 18 also has a fluid inlet 80 located in the curved face 60 that tapers from the opening (shown in FIG. 3). The fluid inlet 80 and the barrel 78 are used in conjunction to restrain lateral movement of the nozzle 20, but allow the nozzle 20 to rotate about the nozzle axis 82.

A sensor 98 for sensing the environment surrounding the clip 10 may be mounted to the base 18 or hook 16. Preferably, the sensor 98 is mounted substantially to the front face 58, but may be mounted on the angled face 60 or any other suitable location providing a view, for example, of the user to accurately determine the presence or absence thereof. The sensor 98 may be a motion sensor, proximity sensor, or the like. The sensor 98 is preferably electrically connected to the container 22 and/or controller (not shown) to influence when the fluid is dispensed to the toilet bowl 12 based upon predetermined logic. It should be appreciated that the sensor can be omitted from the clip 10 in certain embodiments if the sensing function is not desired.

Figure 8:
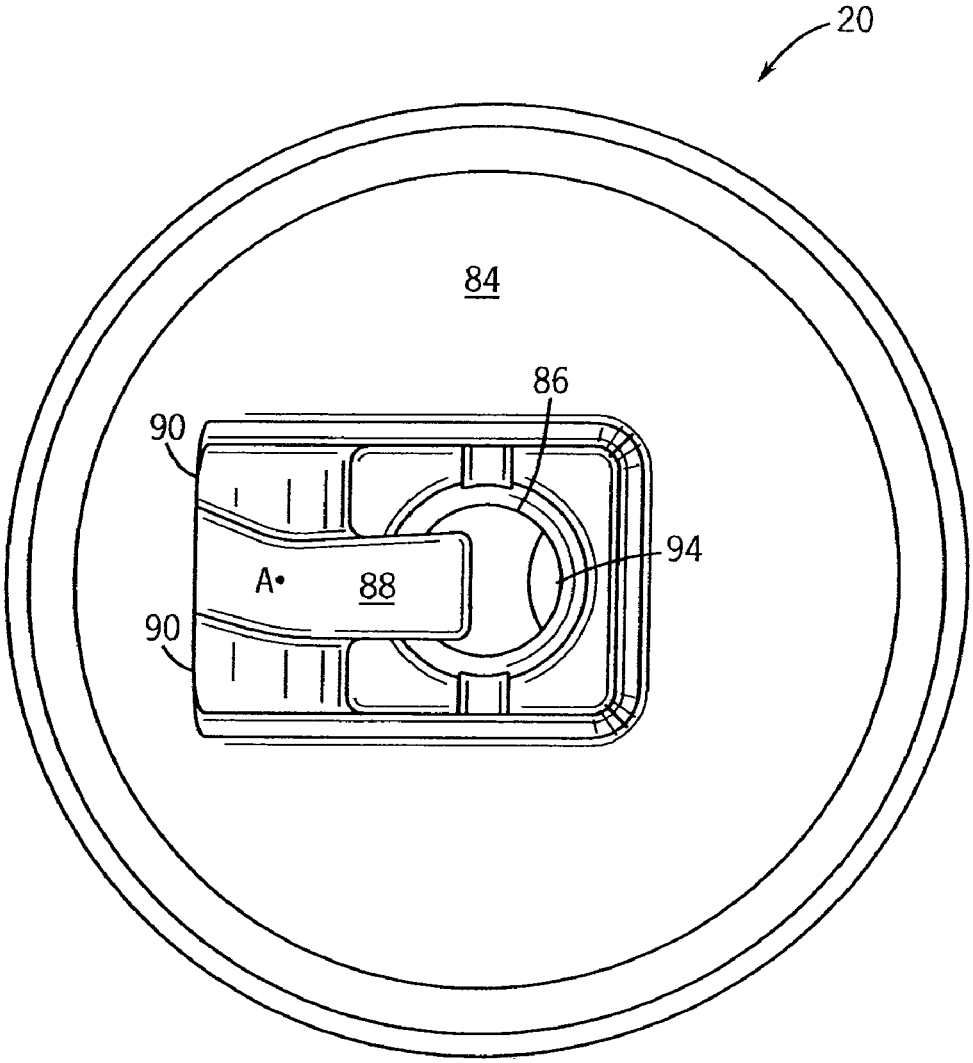
FIG. 8 is a top view of a portion of the nozzle of the clip taken along line 8-8 of FIG. 3.

Turning to FIG. 8, an embodiment of the fluid delivery device 20 is described. The fluid delivery device 20 is preferably molded from plastic (e.g., polyethylene and polypropylene). The nozzle 20 includes a circular deflection plate 84, a passageway 86 extending upwards from the deflection plate 84 and in fluid communication with the fluid inlet 80. A channel 88 extends radially outward from the passageway 86 near the deflection plate 84 and angles away from the initial channel 88 path at point A as shown in FIG. 8. The channel 88 is flanked by a pair of fins 90 that extend upwardly from the deflection plate 84. The contour of the channel 88 and fins 90 may vary depending on the desired rotational speed of the nozzle 20, pressure of the fluid, and the like.

As shown most clearly in FIGS. 3 and 8, the nozzle 20 is restrained laterally in the base 18 by inserting a spindle 92 extending from the underside of the deflection plate 84 into the recess in the barrel 78 of the arm 76 and by inserting the tapered end of the fluid inlet 80 into the passageway 86 where it abuts a ledge 94 formed in the passageway 86. The nozzle 20 is free to rotate about the nozzle axis 82, but is restrained from lateral movement.

The means for attaching the fluid delivery device may include a fluid delivery device 20 suspended from the base 18 without the use of an arm 76. The fluid delivery device, here a nozzle 20, may be snap-fit to the base 18, screwed to the base 18, wedged to the base 18, and the like. Furthermore, an arcuate arm (not shown) may extend from the base 18 to support the fluid delivery device 20.

In operation, fluid is moved from the container 22 through the conduit 24, which is routed through the channels 50 along the hook 16, and into the fluid inlet 80 on the base 18. Fluid flows into the top of the nozzle 20, down the passageway 86 where it is directed radially outward by the channel 88. As the fluid exits the channel 88 its path is altered by the angled fins 90 flanking the channel 88. The reaction causes the nozzle 20 to rotate counterclockwise as viewed in FIG. 8. As a result, the fluid is expelled radially outward from the nozzle 20 onto the inside surface 26 of the toilet bowl 12.

With the general structure and operation of the fluid delivery device described, we turn our attention to the means for rotating the base 18 and thus adjusting the area covered by the fluid dispensed from the nozzle 20. Returning to FIGS. 4 and 6, and with reference to FIG. 7, the base 18 can be rotated relative to the hook 16 about a horizontal axis 96 extending substantially normal from a plane defined by the vertical axis 48 and the back face 52 of the base 18. The slit 66 formed in the channel 64 is flared at the entrance 68 and exit 70. This allows the base 18 to rotate near the intermediate position 72 about the horizontal axis 96 until the rib 44 protruding from the hook 16 abuts the slit sides 45 formed in the back face 52.

Figure 7:
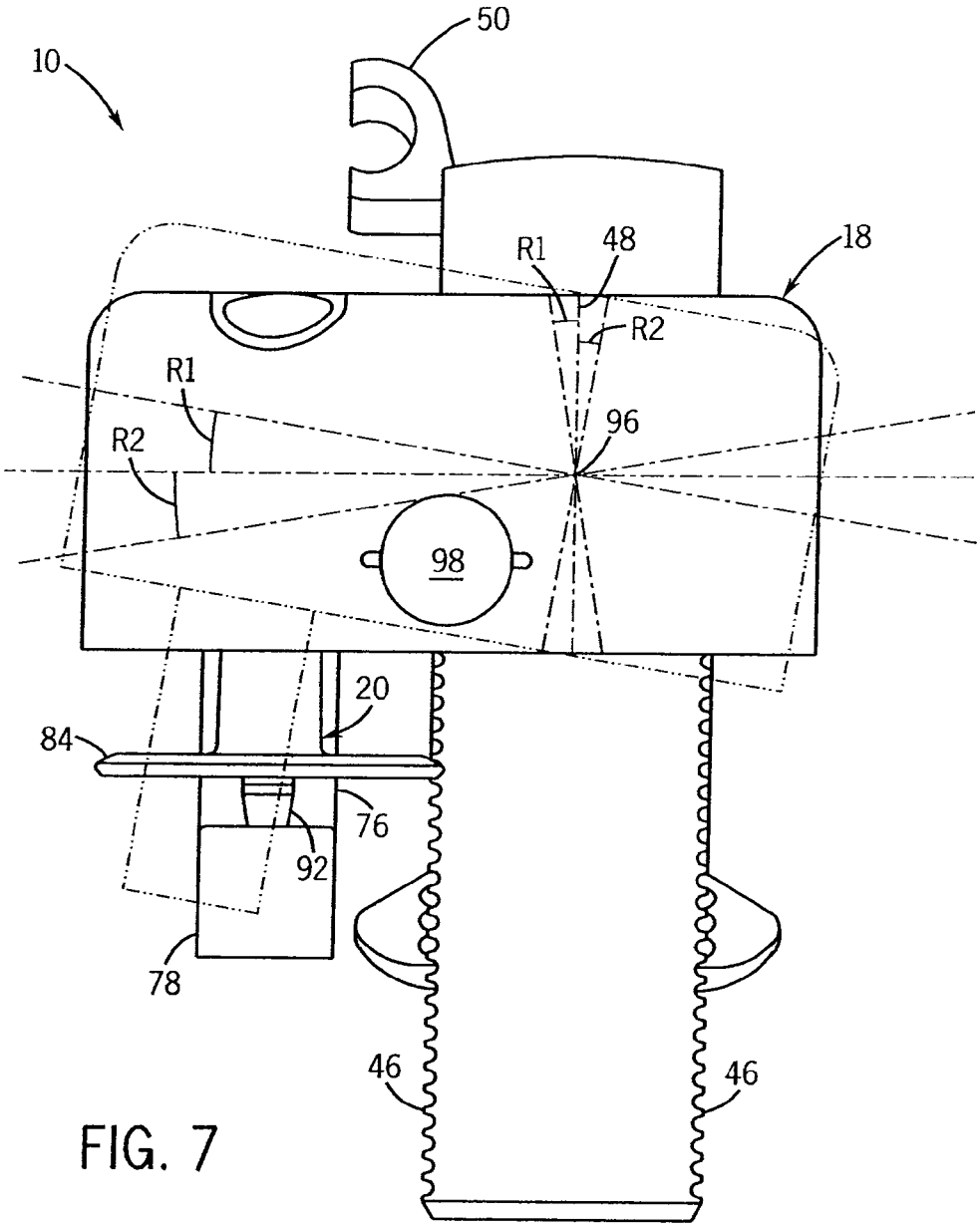
FIG. 7 is a front view of the clip of FIG. 1 showing the clip in rotated (dashed lines) and non-rotated (solid lines) orientations.

For example, with reference to FIG. 7, when the base 18 is rotated by an angle R1 with respect to the vertical axis 48 (shown by dashed lines) the relative placement of the nozzle 20 is angled accordingly, thus altering the area covered by the fluid dispensed from the nozzle 20. Additionally, when the base 18 is rotated by an angle R2 in the opposite direction, the coverage of the fluid dispensed by the nozzle 20 is again altered. As the base 18 rotates, the projections 74 slide within a respective tooth of the ratchet teeth 46; thus, the fit between the projections 74 and the ratchet teeth 46 should allow for the base 18 to rotate freely while also inhibiting vertical movement of the base 18. This rotational adjustment allows the clip 10 to accommodate toilets and enclosures of varying geometries.

The means for rotating the base 18 need not include a slit 66 as described. For example, the back face 52 may include several pairs of opposed fingers in the plane defined by the back face 52 for restraining the rotation of the rib 44 of the hook 16. The opening between a pair of opposed fingers near the entrance and the opening of a pair of opposed fingers near the exit are larger than the opening between a pair of opposed fingers located between the entrance and exit fingers. As a result, the base 18 is capable of rotating until the rib 44 engages the fingers near the entrance and exit. In another embodiment, the slit 66 may have a V-shape wherein the entrance tapers to the exit, or the opposite. Thus, the point of rotation of the base 18 is located near the exit of the slit 66, or smaller of the entrance and exit. Again, the rotation of the base 18 is limited by the rib 44 engaging the slit sides 45.

The rotational adjustment of the base 18 may be performed manually by a user of the clip 10 or automatically as the clip 10 is mounted to the enclosure, here a toilet bowl 12. With general reference to FIGS. 1-4, 6, and 7, the clip 10 is mounted substantially as follows. The clip 10 is secured to the rim 14 of the toilet bowl 12 by urging the hook 16 in the F-F direction away from the base 18 and placing the clip 10 over the rim 14. Once the hook 16 is secured, the base 18 is slid along the vertical axis 48 up the hook 16 and ratchet teeth 46 until the tab 53 engages the underside of the rim 14. As the tab 53 of the base 18 continues to engage the underside of the rim 14, the base 18 is rotated about the horizontal axis 96, thus aligning the nozzle 20 with the plane of the underside of the rim 14 and helping to ensure that the fluid from the nozzle 20 is dispensed onto the inside surface 26 of the toilet bowl 12 (assuming the plane of the underside of the rim 14 is parallel with the plane defined by the topside of the rim 14). The tab 53 may further include an elastomeric grip 51 protruding from the distal end of the tab 53 helping to secure the base 18 in its engaged position on the rim 14. The base 18, need not include a tab 53; in this embodiment, the base 18 may be manually rotated by the user to adjust the base 18 with respect to the hook 16.

Turning now to FIGS. 9-13 and 17-21, there is shown another example embodiment of a clip 110 for mounting a fluid delivery device to an enclosure such as a toilet bowl. The clip 110 is secured to the rim of the toilet bowl by a hook 116 (which is omitted in the views of FIGS. 11 and 18-21) in the same manner as the clip 10 of FIGS. 1-8. A base 118 is supported by the hook 116 and supports a fluid delivery device, here a nozzle 120. A container supplies fluid via a fluid conduit to the fluid delivery device 120 to be dispensed onto the inside surface of the toilet bowl in the same manner as the clip 10 of FIGS. 1-8. The fluid can be supplied from the container to the fluid delivery device 120 in a variety of ways; for example, the fluid may be motivated by a gaseous propellant, by a manual or electric pump, a syringe, or any other suitable means. Furthermore, the execution of the fluid delivery from the container can be controlled by a variety of methods/devices, one being a timing circuit using predetermined logic to control when the fluid is dispensed.

Referring still to FIGS. 9-13 and 17-21, the hook 116 for supporting the base 118 and attaching the clip 110 to the toilet bowl has three main segments. A bowl segment 128, a top rim segment 130, and an inner rim segment 132. All three segments 128, 130, 132 are preferably integrally molded from plastic (e.g., polyethylene or polypropylene) and form a flexible hook 116. The bowl segment 128 has a substantially rectangular cross-section and a flared elastomeric gripping foot 134 with elastomeric ribs 137 at a lower end for helping to secure the clip 110 to the toilet bowl in the same manner as the clip 10 of FIGS. 1-8. Suitable elastomeric materials for the gripping foot 134 and ribs 137 include, without limitation, neoprene, polyurethane rubbers, and silicone rubbers.

The bowl segment 128 extends substantially vertically upward and transitions into the top rim segment 130 at a flexible elbow 135 that allows the hook 116 to flex (as in the G direction shown on FIG. 17) to secure the clip 110 to toilet bowls of various shapes and sizes. The top rim segment 130 has a substantially rectangular cross-section and extends horizontally across the rim of the toilet bowl where it transitions into the inner rim segment 132 at another flexible elbow 136, also allowing the hook 116 to flex. The inner rim segment 132 extends vertically downward from the elbow 136 and is configured to engage and support the base 118. The bowl segment 128 and the top rim segment 130 include a C-shaped channel 150 that restrains the fluid conduit as it is routed around the perimeter of the hook 116 on its way to the nozzle 120 in the base 118. The fluid conduit is pressed into the C-shaped channel 150 in the same manner as the clip 10 of FIGS. 1-8.

The base 118 has a back face 152, a pair of spaced apart side faces 154 extending forward of the back face 152, a top face 156 and a front face 158 extending between the side faces 154. The faces 152, 154, 156, 158 define a cavity. The base 118 is preferably molded from plastic (e.g., polyethylene or polypropylene).

Looking at FIGS. 17,19, 20 and 21, engagement of centrally located, linearly aligned dome-shaped projections 173 of the hook 116 and central arcuate ridges 175*a*, 175*b*, 175*c*, 175*d*, 175*e*, 175*f* on the inner surface 171 of the back wall of the base 118 keep the base 118 vertically restrained on the hook 116. The base 118 includes a channel 164 for receiving the inner rim segment 132 of the hook 116. The channel 164 is dimensioned to be complementary to the inner rim segment 132 of the hook 116 such that the inner rim segment 132 of the hook 116 can slide in the channel 164 with the application of force to the hook 116. A recess 166 in the inner side of the channel 164 receives the rib 144 of the hook 116. The recess 166 terminates in a back wall 167.

When the hook 116 is moved downward in the channel 164, the lowermost of a group of six of the dome-shaped projections 173 rides over the rounded top surface of ridge 175*a* and into a channel 174*a* between the ridges 175*a* and 175*b*. Upon further downward movement of the hook 116, the lowermost of the group of six of the dome-shaped projections 173 rides over the ridge 175*b* and into a channel 174*b* between the ridges 175*b* and 175*c*, and the dome-shaped projection adjacent and above the lowermost of the group of six of the dome-shaped projections 173 rides over the ridge 175*a* and into the concave channel 174*a* between the ridges 175*a* and 175*b*. As the hook is moved further downward, the lowermost of the group of six of the dome-shaped projections 173 rides over the rounded top surface of ridges 175*c*, 175*d*, and 175*e* respectively and into concave channels 174*c*, 174*d*, 174*e*. The trailing dome-shaped projections ride over ridges and move into channels sequentially. When the dome-shaped projections 173 reside in the channels 174*a*, 174*b*, 174*c*, 174*d*, 174*e*, the base 118 can be vertically restrained on the hook 116 until a further downward force is placed on the hook 116 and the dome-shaped projections 173 ride downward over an adjacent ridge.

The clip 110 includes means for rotating the base 118 and thus adjusting the area covered by the fluid dispensed from the nozzle 120. Looking at FIGS. 17 to 21, the base 118 can be rotated relative to the hook 116 about a horizontal axis 196 extending substantially normal from a plane defined by the vertical axis 148 and the back face 152 of the base 118. Recess 166 is formed in a channel 164 which is flared at the entrance 168 and exit 170. This allows the base 118 to rotate near the intermediate position 172 about the horizontal axis 196 until the rib 144 protruding from the hook 116 abuts the recess sides 145 formed in the base 118.

Figure 17:
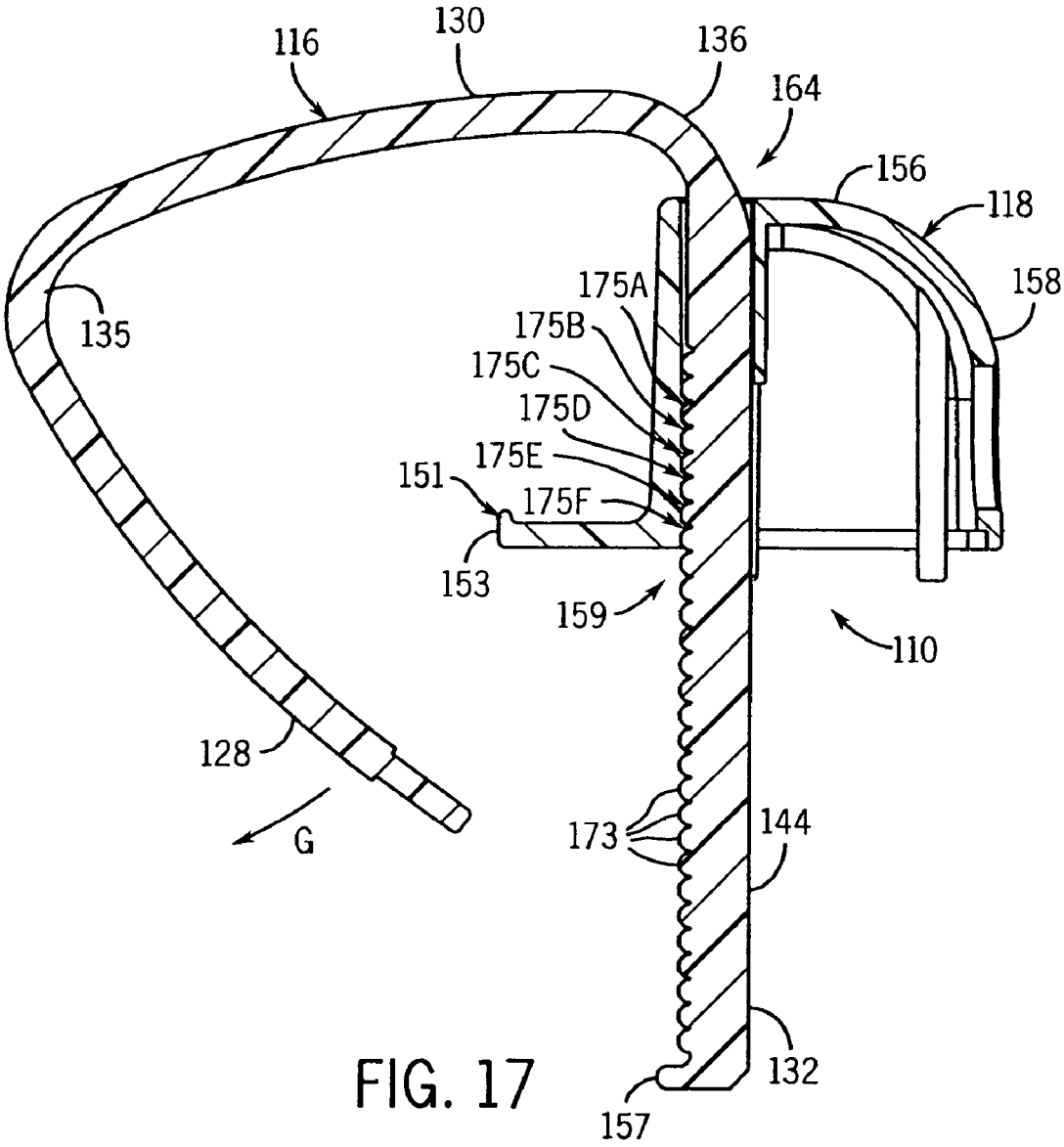
FIG. 17 is a cross-sectional view of the clip of FIG. 9 taken along line 17-17 of FIG. 9.
Figure 18:
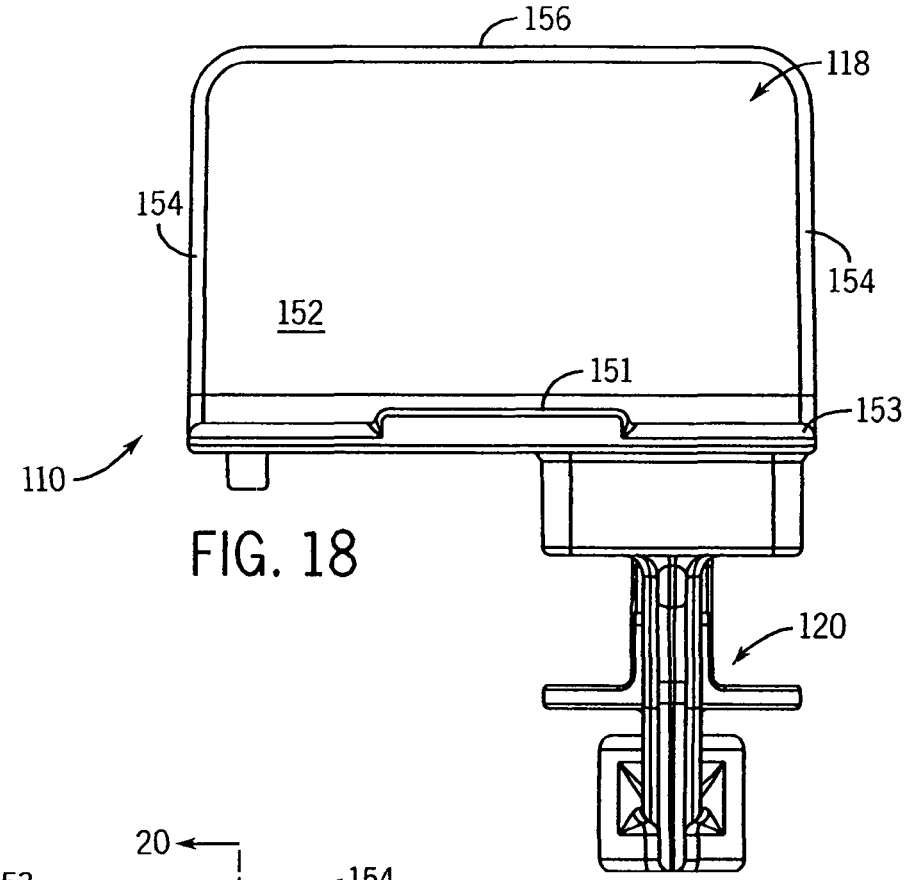
FIG. 18 is a rear view of the clip of FIG. 9 with the hook removed.
Figure 19:
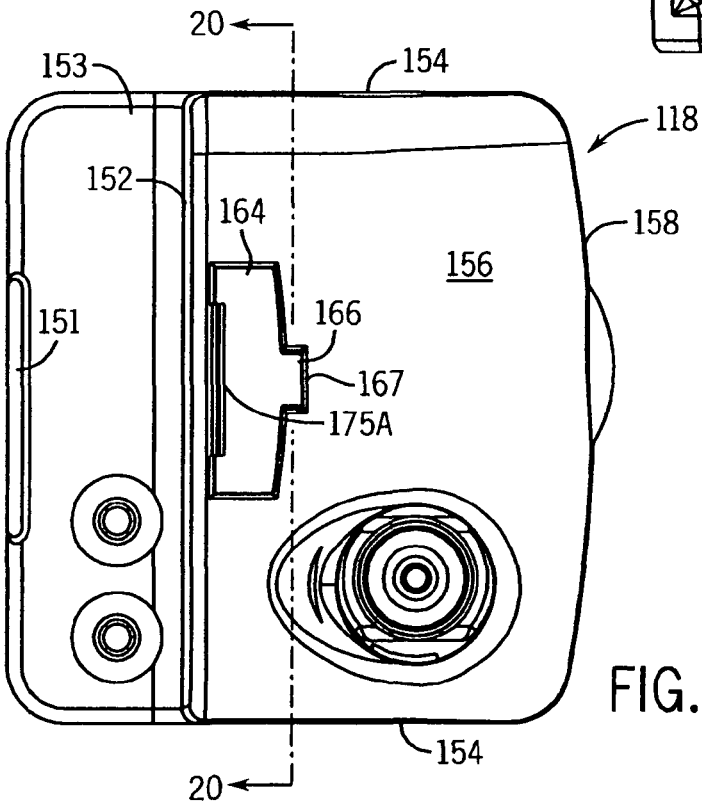
FIG. 19 is a top view of the clip of FIG. 9 with the hook removed.
Figure 20:
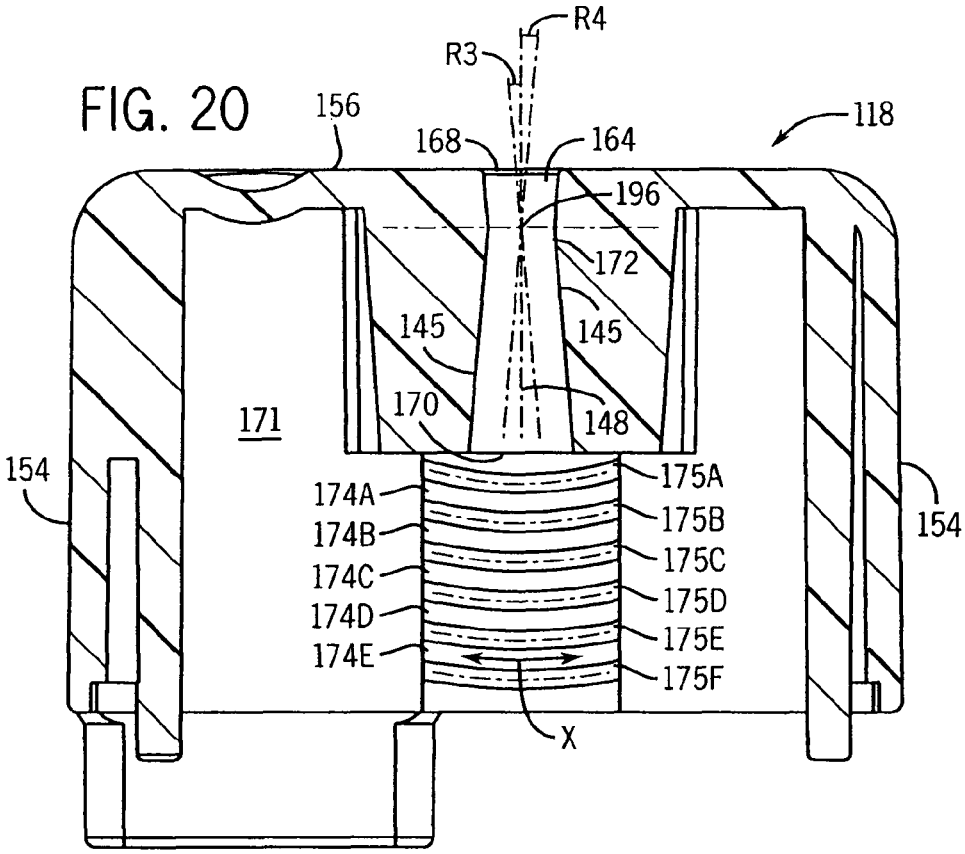
FIG. 20 is a cross-sectional view of the clip housing of FIG. 19 taken along line 20-20 of FIG. 19.
Figure 21:
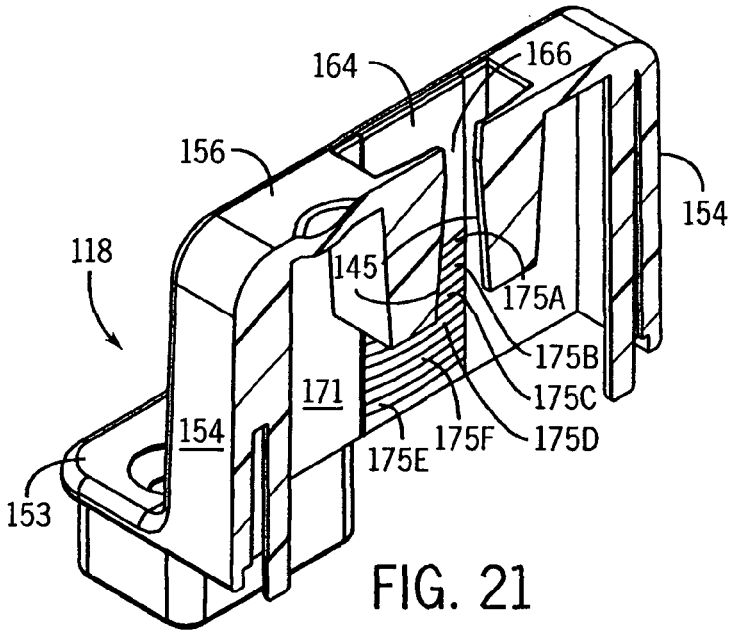
FIG. 21 is a perspective view of the cross-sectional view of the clip housing of FIG. 20.

For example, with reference to FIGS. 17 and 20, when the base 118 is rotated by an angle R3 with respect to the vertical axis 148 (shown by dashed lines) the relative placement of the nozzle 120 is angled accordingly, thus altering the area covered by the fluid dispensed from the nozzle 120. Additionally, when the base 118 is rotated by an angle R4 in the opposite direction, the coverage of the fluid dispensed by the nozzle 120 is again altered. As the base 118 rotates, the dome-shaped projections 173 of the hook 116 travel in an arcuate path (X in FIG. 20) within the arcuate channels 174*a*, 174*b*, 174*c*, 174*d*, 174*e* formed on the inner surface of the base 118 by the spaced apart arcuate ridges 175*a*, 175*b*, 175*c*, 175*d*, 175*e*, 175*f*. The ridges 175*a*, 175*b*, 175*c*, 175*d*, 175*e*, 175*f* also inhibit vertical movement of the base 118 as described above. This rotational adjustment allows the clip 110 to accommodate toilets and enclosures of varying geometries. While six ridges 175*a*, 175*b*, 175*c*, 175*d*, 175*e*, 175*f* have been illustrated herein, it should appreciated that the use of one or more ridges can be suitable for vertical and rotational adjustment of the base 118 on the hook 116.

The rotational adjustment of the base 118 may be performed manually by a user of the clip 110 or automatically as the clip 110 is mounted to the enclosure (e.g., a toilet bowl). The clip 110 is secured to the rim of the toilet bowl by urging the hook 116 in the G direction (see FIG. 17) away from the base 118 and placing the clip 110 over the rim. Once the hook 116 is secured, the base 118 is slid along the vertical axis 148 up the hook 116 until the tab 153 engages the underside of the rim. As the tab 153 of the base 118 continues to engage the underside of the rim, the base 118 is rotated about the horizontal axis 196, thus aligning the nozzle 120 with the plane of the underside of the rim and helping to ensure that the fluid from the nozzle 120 is dispensed onto the inside surface of the toilet bowl. The tab 153 may further include an elastomeric grip 151 protruding from the distal end of the tab 153 helping to secure the base 118 in its engaged position on the rim. The base 118 need not include a tab 153; in this embodiment, the base 118 may be manually rotated by the user to adjust the base 118 with respect to the hook 116. Optionally, the hook 116 includes a protruding tab 157 that limits movement of the end of the hook 116 above the underside 159 of the base 118.

A sensor 198 for sensing the environment surrounding the clip 110 may be mounted to the base 118. Preferably, the sensor 198 is mounted substantially to the front face 158, but may be mounted on any other suitable location providing a view, for example, of the user to accurately determine the presence or absence thereof. The sensor 198 may be a motion sensor, proximity sensor, or the like. The sensor 198 is preferably electrically connected to the container and/or controller (not shown) to influence when the fluid is dispensed to the toilet bowl based upon predetermined logic.

Figure 12:
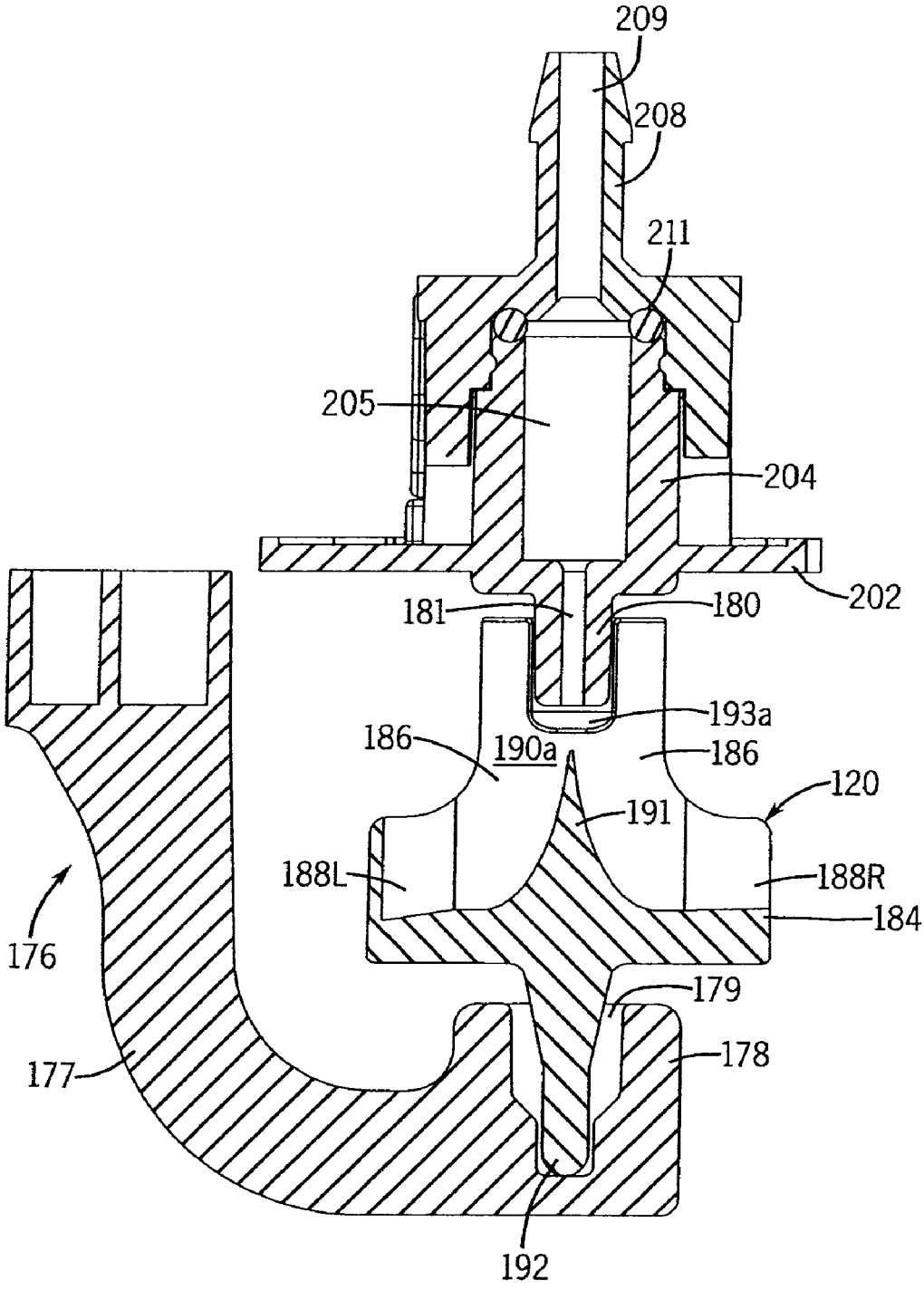
FIG. 12 is a vertical cross-sectional view of the fluid inlet, nozzle and support arm of the clip of FIG. 9.

Looking at FIG. 12, the base 118 further includes a means to attach a fluid delivery device (e.g., nozzle 120) to the base 118. In the example embodiment, the nozzle 120 is restrained laterally between a barrel 178 and a fluid inlet 180. The base 118 includes an arm 176 extending downward from the base 118. The arm 176 has a curved section 177 with a J-shaped bend extending forward to the barrel 178 located at the distal end of the curved section 177. The fluid inlet 180 and the barrel 178 are used in conjunction to restrain lateral movement of the nozzle 120, but allow the nozzle 120 to rotate about the nozzle axis 182. The tubular fluid inlet 180 defines a flow path 181, and extends downwardly from a lower base floor 202 that is attached to the base 118. The base floor 202 includes an upwardly extending tubular sleeve 204 that defines a flow path 205. The base 118 is also attached to a fluid supply port 208 that defines a flow path 209. The fluid supply port 208 and the tubular sleeve 204 are snap fit together with an O-ring 211 therebetween to create fluid tight seal. The fluid supply port 208 is located in a recess 213 in the top face 156 of the base, and may be connected to a fluid conduit (such as conduit 24 in FIG. 3).

Figure 10:
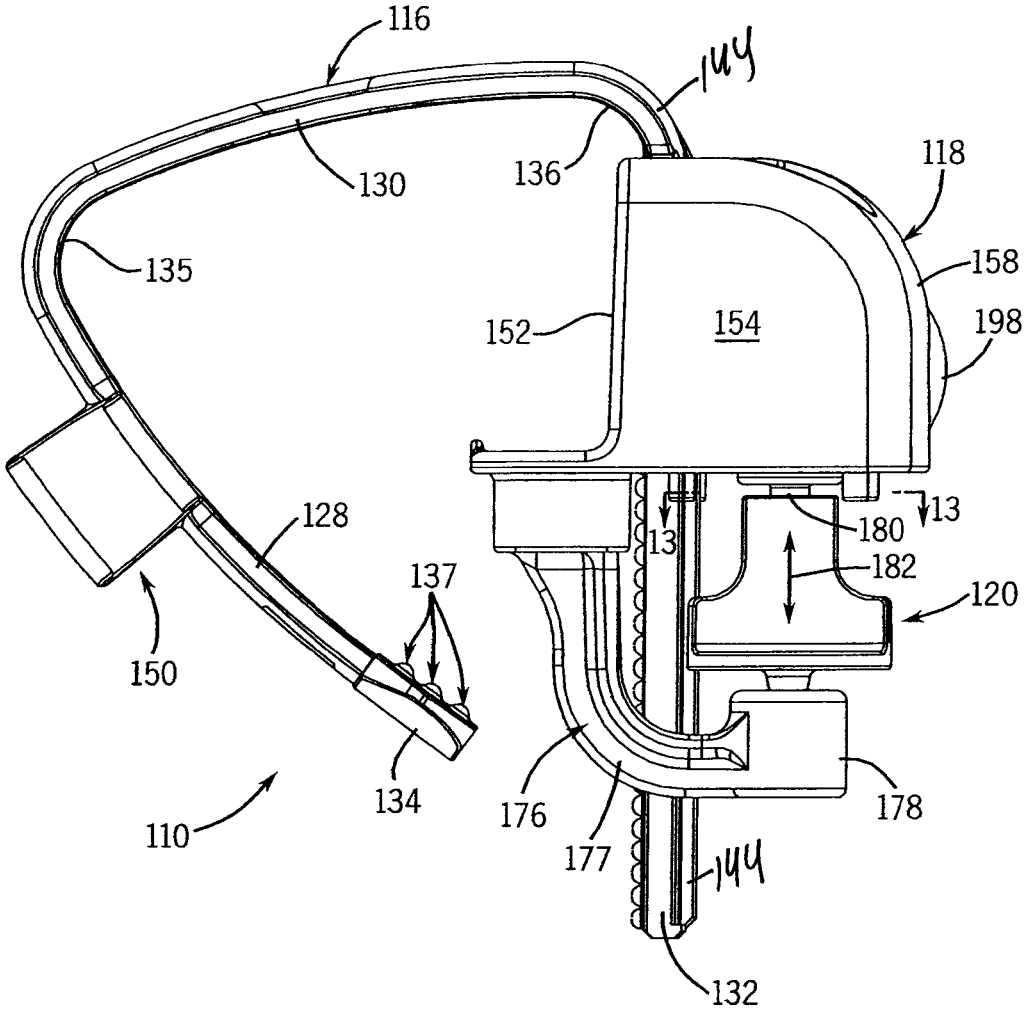
FIG. 10 is a side view of the clip of FIG. 9.
Figure 11:
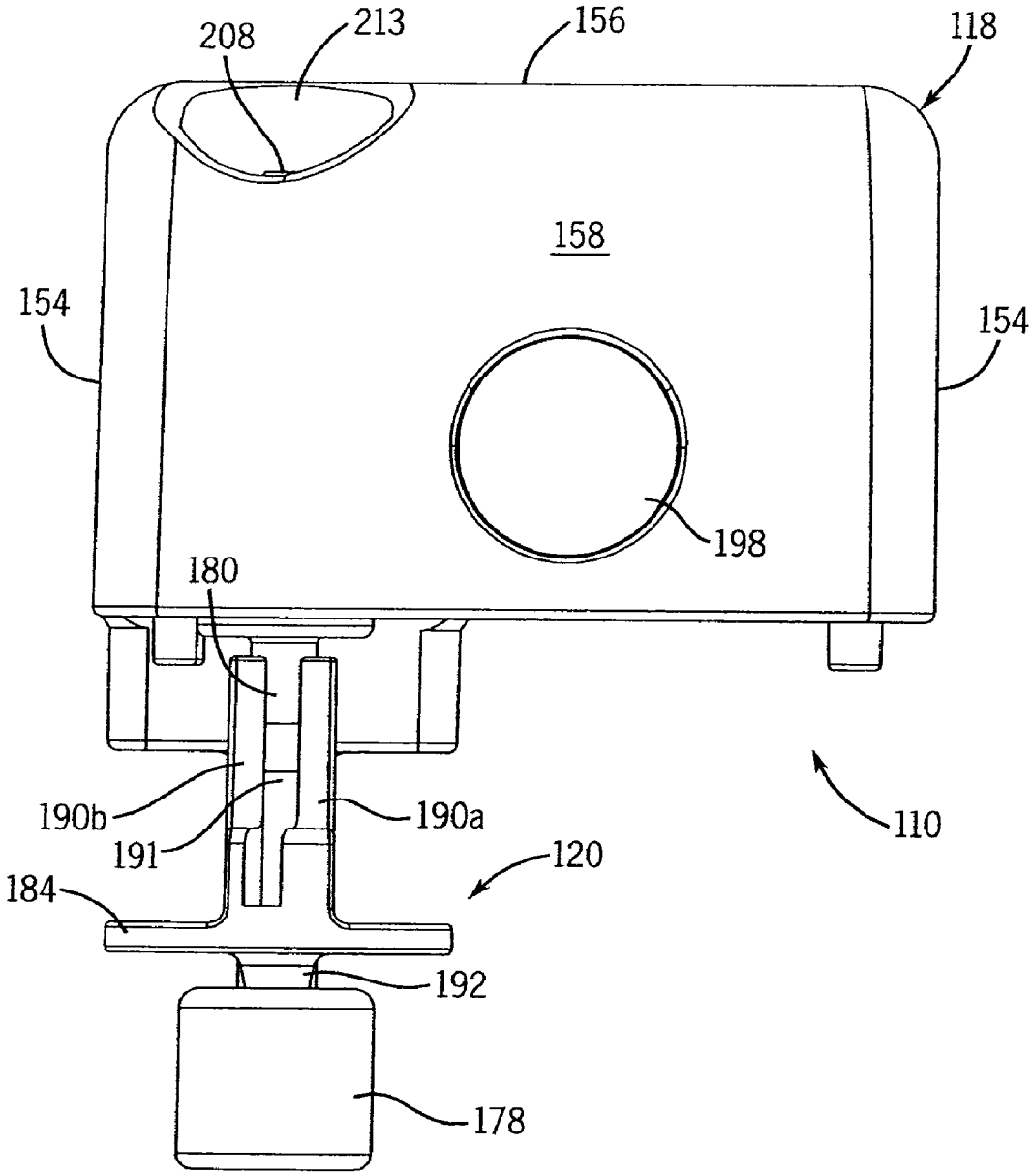
FIG. 11 is a front view of the clip of FIG. 9 with the hook removed.
Figure 13:
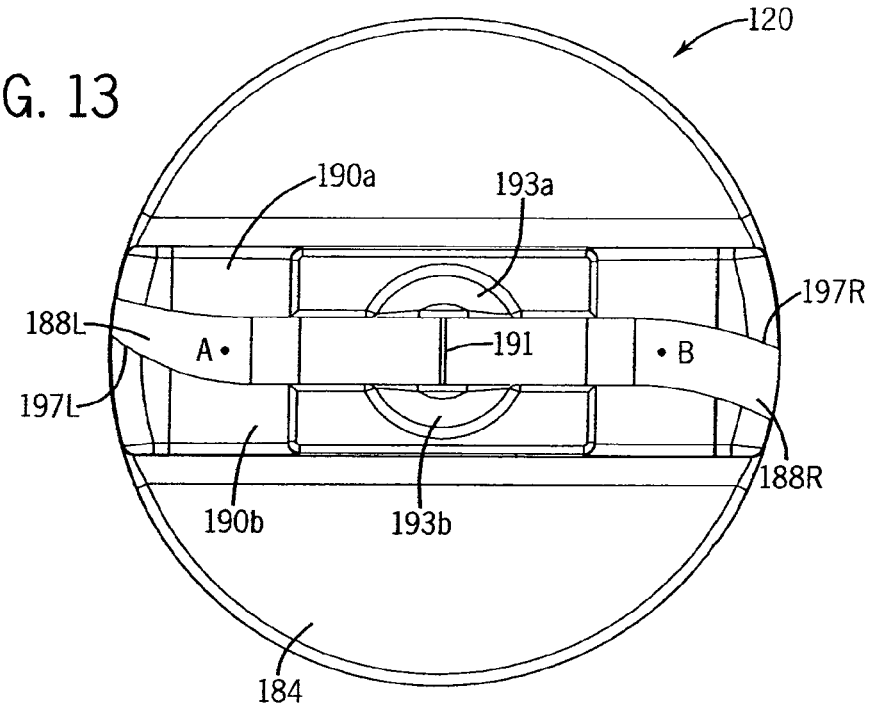
FIG. 13 is a top view of a portion of the nozzle of the clip taken along line 13-13 of FIG. 10.

Referring to FIGS. 10 and 12 and 13, the nozzle 120 is shown in greater detail. The nozzle 120 is preferably molded from plastic (e.g., polyethylene and polypropylene). The nozzle 120 includes a circular deflection plate 184. An axial spindle 192 extends downward from the deflection plate 184. Spaced apart walls 190*a*, 190*b*, which have a generally inverted T-shape, extend upward from the deflection plate 184. In the embodiment of FIG. 13, the walls 190*a*, 190*b*, extend all the way across the deflection plate 184 from opposed outer edges of the deflection plate 184. A central fluid deflection peak 191 extends upward from the deflection plate 184 between the walls 190*a*, 190*b*. The top of the wall 190*a* has a generally U-shaped (when viewed in vertical cross-section) inwardly directed depression 193*a*, and the top of the wall 190*b* has a generally U-shaped (when viewed in vertical cross-section) inwardly directed depression 193*b*. A passageway 186 is defined by the walls 190*a*, 190*b* and the passageway 186 extends upwards from the deflection plate 184 and in is fluid communication with the depressions 193*a*, 193*b*. A channel 188L extends radially outward from the passageway 186 near the deflection plate 184 and angles rearwardly away from the initial channel 188L path at point A as shown in FIG. 13. A channel 188R extends radially outward from the passageway 186 near the deflection plate 184 and angles forwardly away from the initial channel 188R path at point B as shown in FIG. 13. The contour of the channels 188L, 188R and walls 190*a*, 190*b* may vary depending on the desired rotational speed of the nozzle 120, the pressure of the fluid, the flow rate of the fluid, and the like.

As shown most clearly in FIG. 12, the nozzle 120 is restrained laterally by inserting a spindle 192 into a recess 179 in the barrel 178 of the arm 176 and by inserting the end of the fluid inlet 180 between depressions 193*a*, 193*b*. The nozzle 120 is free to rotate about the nozzle axis 182, but is restrained from lateral movement.

In operation, fluid is moved from a container through a fluid conduit (see, for example, the container 22 and the conduit 24 of FIG. 1) and into the fluid supply port 208. Looking at FIG. 12, the fluid flows through the flow paths 209, 205, and 181, and out of the fluid inlet 180. (The diameter of the exit orifice of the fluid inlet can dictate the pressure which helps to dictate the spin rate and the distance of fluid travel off the nozzle 120.) Fluid flows onto the top of the fluid deflection peak 191 and down the forked passageways 186 where it is directed radially outward by the channels 188L, 188R. As the fluid exits the channels 188L, 188R, the fluid path is altered by the angled inner surfaces 197L, 197R flanking the channels 188L, 188R. The reaction causes the nozzle 120 to rotate counterclockwise as viewed in FIG. 13. As a result, the fluid is expelled radially outward from the nozzle 120 onto the inside surface of the enclosure such as a toilet bowl.

Figure 14:
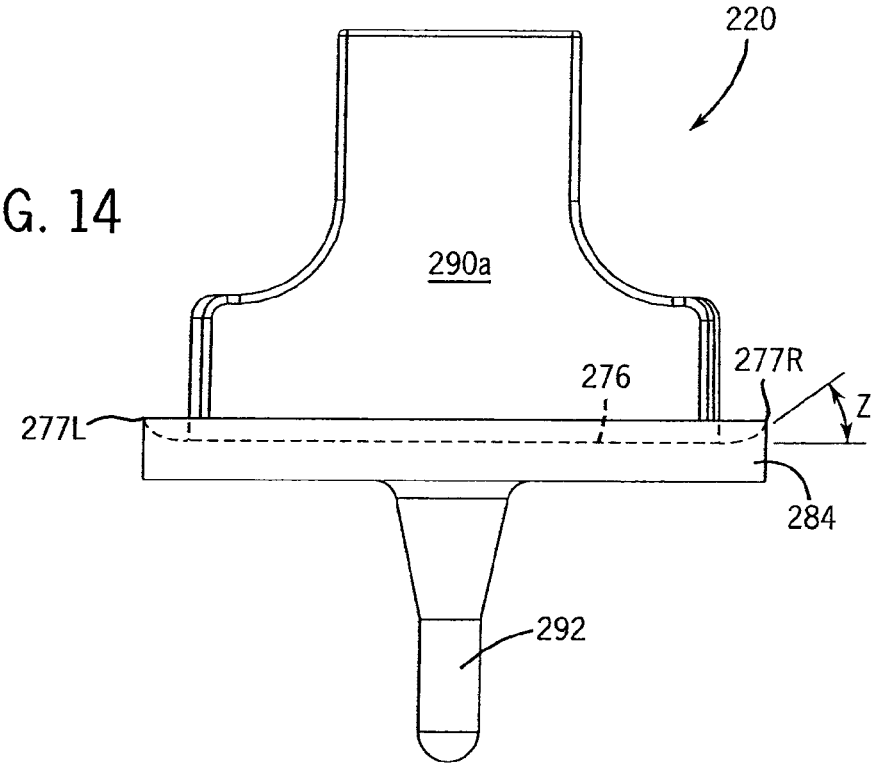
FIG. 14 is a front elevational view of yet another nozzle suitable for use with the invention.
Figure 15:
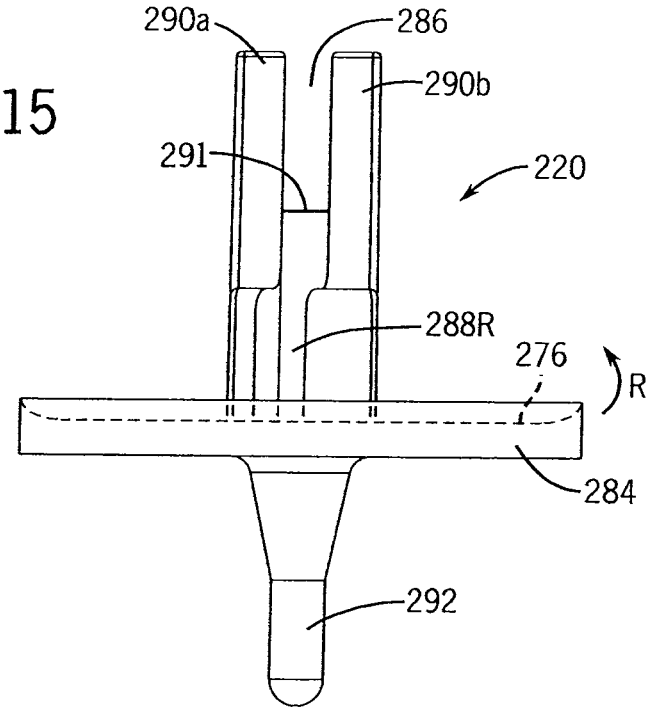
FIG. 15 is a side elevational view of the nozzle of FIG. 14.

Referring to FIGS. 14 and 15, another embodiment of a nozzle 220 is shown in greater detail. The nozzle 220 is preferably molded from plastic (e.g., polyethylene and polypropylene). The nozzle 220 includes a circular (from a top view) deflection plate 284. An axial spindle 292 extends downward from the deflection plate 284. Spaced apart walls 290*a*, 290*b*, which have a generally inverted T-shape, extend upward from the deflection plate 284. In the embodiment of FIGS. 14 and 15, the walls 290*a*, 290*b*, extend from a location spaced inward from an outer edge point 277L of the deflection plate 284 to a location spaced inward from an outer edge point 277R of the deflection plate 284. A central fluid deflection peak 291 (similar to fluid deflection peak 191 of FIGS. 12 and 13) extends upward from the deflection plate 284 between the walls 290*a*, 290*b*. The top of the wall 290*a* has a generally U-shaped inwardly directed depression (similar to inwardly directed depression 193*a* in FIGS. 12 and 13), and the top of the wall 290*b* has a generally U-shaped inwardly directed depression (similar to inwardly directed depression 193*b* in FIGS. 12 and 13).

Still referring to FIGS. 14 and 15, a passageway 286 (similar to passageway 186 in FIGS. 12 and 13) is defined by the walls 290*a*, 290*b* and the passageway 286 extends upwards from the deflection plate 284 and in is fluid communication with the depressions in the walls 290*a*, 290*b*. A channel (similar to channel 188L in FIGS. 12 and 13) extends radially outward from the passageway 286 near the deflection plate 284 and angles rearwardly away from the initial channel as in FIG. 13. A channel 288R extends radially outward from the passageway 286 (similar to channel 188R in FIGS. 12 and 13) and angles forwardly away from the initial channel 288R path as shown in FIG. 15. The deflection plate 284 has a dished floor 276 that creates a draft angle Z (see FIG. 14) at the outer edge of the top of the deflection plate 284. The contour of the draft angle Z, the channels, and the walls 290*a*, 290*b* may vary depending on the desired rotational speed of the nozzle 220, the pressure of the fluid, the flow rate of the fluid, and the like.

Similar to FIG. 12, the nozzle 220 may be restrained laterally by inserting the spindle 292 into a recess 179 in the barrel 178 of the arm 176 and by inserting the end of the fluid inlet 180 between upper depressions in the walls 290*a*, 290*b*. The nozzle 220 is free to rotate about the nozzle axis, but is restrained from lateral movement. In operation, fluid is moved from a container through a fluid conduit (see, for example, the container 22 and the conduit 24 of FIG. 1) and into the fluid supply port 208 as in FIG. 12, the fluid flows through the flow paths 209, 205, and 181, and out of the fluid inlet 180. Fluid flows onto the top of the fluid deflection peak 291 of nozzle 220 and down the forked passageways 286 where it is directed onto the floor 276 and radially outward by the channels. As the fluid exits the channels, the fluid path is altered by the angled inner surfaces of the walls 290*a*, 290*b* flanking the channels. The reaction causes the nozzle 220 to rotate right in direction R as in FIG. 15. The fluid continues to flow on the floor 276 and then moves up the draft angle at the edge of the deflection plate 284 to create a slightly upward travel path for the fluid. As a result, the fluid is expelled radially outward from the nozzle 220 onto the inside surface of the toilet bowl, with the slightly upward travel path for the fluid allowing for under the toilet rim contact of the fluid with the inner surface of the toilet bowl even after 18 or more inches of travel.

Comparing FIGS. 8, 13 and 14, the nozzle 20, the nozzle 120, and the nozzle 220 have differences in structure that can lead to different operating characteristics. For example, the nozzle 20 has a single channel 88 extending away from the passageway 86, whereas nozzle 120 and nozzle 220 have two channels extending away from the central passageway. The extra passageway can serve to get maximum work out of the nozzle and improve efficiency. The nozzle 120 and nozzle 220 also have fluid deflection peaks 191, 291 that can improve efficiency. Comparing nozzle 120 and nozzle 220, it can be seen that the walls 190*a*, 190*b* of nozzle 120 extend all the way across the deflection plate 184 from opposed outer edges of the deflection plate 184, whereas walls 290*a*, 290*b* of nozzle 220 are spaced inward from opposed outer edges of the deflection plate 284. The spacing of the walls from the edge of the plate can create more tangential motion in the fluid expelled from the nozzle 220. The centripetal force causes fluid to spin and shear off. Also, the draft angle Z at the outer edge of the nozzle 220 can provide for a spray of about 18 inches without having the level of liquid spray drop down. This is advantageous as it prevents the spray from failing down so far that it does not hit under the upper areas under the toilet rim.

Various parameters of the nozzles 20, 120, 220 can be varied depending on the application for the nozzles. For example, in a nozzle suitable for use in a toilet cleaning device, fluid flow is downward unto the deflection plate to create a spray that moves downward less quickly after leaving the surface of the deflection plate. The design parameters of the nozzles 20, 120, 220 can be varied to accommodate lower fluid pressures, such as 10 to 20 psi (69 to 138 kilopascals), and fluid travel paths of less than 24 inches (0.6096 meters), and flow rates below 10 gallons per hour (37.85 liters per hour). Therefore, the operating parameters of pressure, volume, and flow rate can be accommodated by varying the design of the nozzles 20, 120, 220. Fluid pressures of 14 to 15 psi (96 to 103 kilopascals) and fluid travels paths of up to 18 inches (0.4572 meters) are most preferred in a toilet application.

Figure 9:
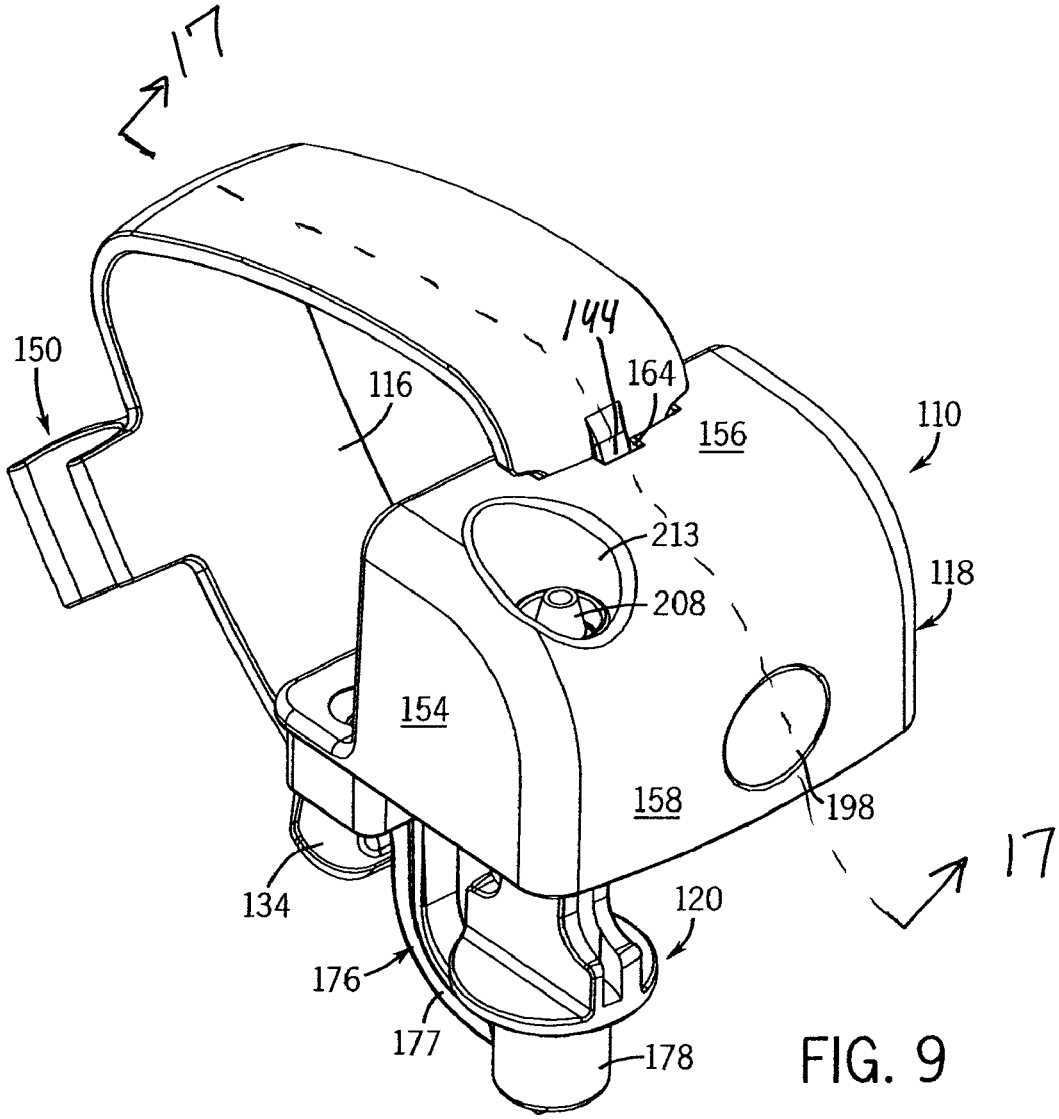
FIG. 9 is a perspective view of another embodiment of a clip for mounting a fluid delivery device in accordance with the invention.
Figure 16:
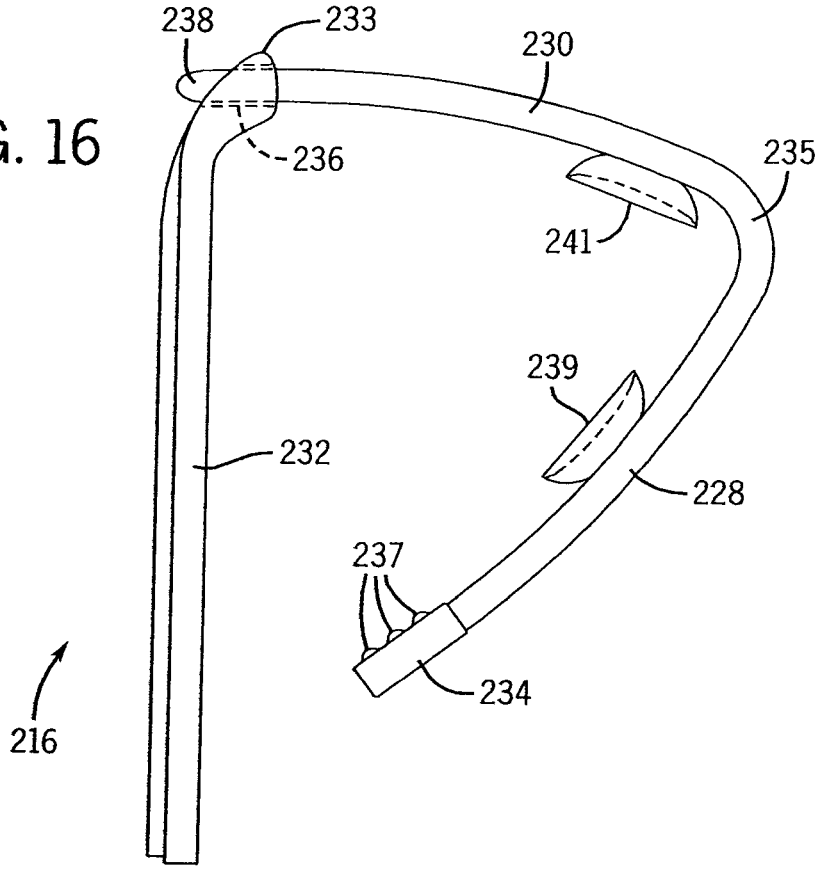
FIG. 16 is a side view of another hook suitable for use with the clip of FIG. 9.

Turning now to FIG. 16, there is shown a side view of another hook 216 suitable for use with the clip of FIG. 9. The hook 216 has three main segments, i.e., a bowl segment 228, a top rim segment 230, and an inner rim segment 232. All three segments 228, 230, 232 are preferably molded from plastic (e.g., polyethylene or polypropylene). The bowl segment 128 has a substantially rectangular cross-section and a flared elastomeric gripping foot 234 with oblong elastomeric ribs 237 at a lower end for helping to secure the hook 216 to the toilet bowl in the same manner as the clip 10 of FIGS. 1-8. Suitable elastomeric materials for the gripping foot 234 and ribs 237 include, without limitation, neoprene, polyurethane rubbers, and silicone rubbers. The bowl segment 228 extends substantially vertically upward and transitions into the top rim segment 230 at a flexible elbow 235 that allows the hook 216 to flex. The top rim segment 230 has a substantially rectangular cross-section and extends horizontally across the rim of the toilet bowl.

Still referring to FIG. 16, the inner rim segment 232 of the hook 216 is configured to engage and support the base 118 as described above with reference to the embodiment of the clip 110 of FIGS. 9-15. The upper end of the inner rim segment 232 has a lateral generally rectangular passageway 236 that extends through the inner rim segment 232. A distal end 238 of the top rim segment 230 is inserted in the passageway 236 such that the bowl segment 228 and the inner rim segment 232 are movable toward and away from each other. This horizontal expansion and contraction of the hook 216 further accommodates various toilet bowl rim width sizes. Also, the inner surface of the bowl segment 228 includes a suction cup 239, and the inner surface of the top rim segment 230 includes a suction cup 241. The bowl segment 228 may be adhered to the toilet rim 14 by suction cup 239, and the top rim segment 230 may be adhered to the toilet rim 14 by suction cup 241.

Thus, the present invention provides a clip for mounting a fluid delivery device where the base of the clip is rotatable relative to the hook such that fluid is dispensed onto the inner surface of the enclosure, and further, where a sensor prevents dispensing fluid at undesired periods. As a result, full coverage of the fluid around the inner surface of the enclosure is possible during preferred periods.

Although the present invention has been described in detail with reference to certain embodiments, one skilled in the art will appreciate that the present invention can be practiced by other than the described embodiments, which have been presented for purposes of illustration and not of limitation. Therefore, the scope of the invention should not be limited to the description of the embodiments contained herein.

INDUSTRIAL APPLICABILITY

The present invention provides a clip for mounting a fluid delivery device where the base of the clip is rotatable relative to the hook such that fluid is dispensed onto the inner surface of the enclosure, and further, where a sensor prevents dispensing fluid at undesired periods.

What is claimed is:

1. A clip for mounting a fluid delivery device adjacent a wall of an enclosure, the clip comprising:
- a base;
- a hook configured to support the base adjacent the wall;
- means for attaching a fluid delivery device to the base; and
- a connector rotatably connecting the base and the hook, the connector including:
  - a rib protruding from the hook;
  - a channel formed in the base for receiving the hook; and
  - a recess formed in the channel for receiving the rib, the recess including an entrance, an exit, and an intermediate position between the entrance and the exit, wherein the width of the recess decreases from the entrance to the intermediate position and increases from the intermediate position to the exit to allow relative rotation between the hook and the base about a point located near the intermediate position of the recess;
- wherein rotation of the base with respect to the hook is limited.

2. The clip of claim 1 wherein:
- the hook includes projections on a surface of the hook opposite the rib,
- the base includes at least one arcuate ridge on an inner surface of the base, and
- at least one of the projections travels adjacent at least one arcuate ridge when the base is rotated with respect to the hook.

3. The clip of claim 1 wherein:
- the hook includes projections on a surface of the hook opposite the rib,
- the base includes a plurality of arcuate ridges on an inner surface of the base, adjacent arcuate ridges defining a channel therebetween, and
- at least one of the projections travels in the channel when the base is rotated with respect to the hook.

4. The clip of claim 1 wherein:
- the hook includes domed projections on a surface of the hook opposite the rib,
- the base includes a plurality of arcuate ridges on an inner surface of the base, the ridges having a rounded top surface, adjacent arcuate ridges defining a concave channel therebetween, and
- at least one of the projections travels in the channel when the base is rotated with respect to the hook.

5. The clip of claim 4 wherein:
- the projections are centrally located and linearly aligned on the surface of the hook.

6. A clip for mounting a fluid delivery device adjacent a wall of an enclosure, the clip comprising:
- a base;
- a hook configured to support the base adjacent the wall;
- means for attaching a fluid delivery device to the base; and
- a connector rotatably connecting the base and the hook; the connector comprising:
  - a rib protruding from the hook;
  - a channel formed in the base for receiving the hook; and
  - a slit formed in the channel comprising an entrance, an exit, and an intermediate position between the entrance and the exit for receiving the rib, wherein the width of the slit decreases from the entrance to the intermediate position and increases from the intermediate position to the exit to allow relative rotation between the hook and the base about a point located near the intermediate position of the slit;
- wherein rotation of the base with respect to the hook is limited.

7. The clip of claim 6, wherein:
- the hook comprises ratchet teeth; and
- the channel comprises at least one protrusion for engaging the ratchet teeth to resist sliding movement between the hook and base.

8. The clip of claim 1, wherein the means for attaching a fluid delivery device to the base comprises an arm extending from the body.

9. The clip of claim 8, wherein the arm comprises:
- a support segment; and
- a barrel at the distal end of the support segment for supporting a fluid delivery device.

10. The clip of claim 1, wherein:
- the base comprises a fluid inlet; and
- the clip includes a fluid delivery device comprising a nozzle in fluid communication with the fluid inlet.

11. The clip of claim 10, wherein the nozzle comprises:
- a deflection plate;
- a passageway in fluid communication with the fluid inlet at an upper end of the passageway, the passageway extending between the fluid inlet and the deflection plate;
- a channel in fluid communication with a lower end of the passageway; and
- a pair of fins flanking the channel and extending upwardly from the deflection plate, the fins being contacted by fluid to rotate the nozzle.

12. The clip of claim 10, wherein the nozzle comprises:
- a deflection plate;
- a passageway in fluid communication with the fluid inlet at an upper end of the passageway, the passageway extending between the fluid inlet and the deflection plate;
- a pair of channels in fluid communication with a lower end of the passageway; and
- a pair of fins flanking the channels and extending upwardly from the deflection plate, the fins being contacted by fluid to rotate the nozzle.

13. A device for spraying an inner surface of an enclosure with a fluid, the device comprising:
- a container for the fluid;
- a fluid delivery device through which the fluid can be applied to the inner surface of the enclosure;
- a fluid conduit in fluid communication with the container and the fluid delivery device;

means for delivering fluid from the container through the fluid conduit and to the fluid delivery device; and a clip for mounting the fluid delivery device adjacent the inner surface of the enclosure, the clip comprising:

a base; and a hook configured to support the base adjacent the inner surface of the enclosure, and a connector rotatably connecting the base and the hook, the connector comprising:

a rib protruding from the hook;

a channel formed in the base for receiving the hook; and a recess formed in the channel for receiving the rib, the recess including an entrance, an exit, and an intermediate position between the entrance and the exit, wherein the width of the recess decreases from the entrance to the intermediate position and increases from the intermediate position to the exit to allow relative rotation between the hook and the base about a point located near the intermediate position of the recess;

wherein rotation of the base with respect to the hook is limited.

14. The device of claim 13 wherein:

the hook includes projections on a surface of the hook opposite the rib, the base includes at least one arcuate ridge on an inner surface of the base, and at least one of the projections travels adjacent at least one arcuate ridge when the base is rotated with respect to the hook.

15. The device of claim 13 wherein:

the hook includes projections on a surface of the hook opposite the rib, the base includes a plurality of arcuate ridges on an inner surface of the base, adjacent arcuate ridges defining a channel therebetween, and at least one of the projections travels in the channel when the base is rotated with respect to the hook.

16. The device of claim 13 wherein:

the hook includes domed projections on a surface of the hook opposite the rib, the base includes a plurality of arcuate ridges on an inner surface of the base, the ridges having a rounded top surface, adjacent arcuate ridges defining a concave channel therebetween, and at least one of the projections travels in the channel when the base is rotated with respect to the hook.

17. The device of claim 16 wherein:

the projections are centrally located and linearly aligned on the surface of the hook.

18. A device for spraying an inner surface of an enclosure with a fluid, the device comprising:

a container for the fluid;

a fluid delivery device through which the fluid can be applied to the inner surface of the enclosure;

a fluid conduit in fluid communication with the container and the fluid delivery device;

means for delivering fluid from the container through the fluid conduit and to the fluid delivery device; and a clip for mounting the fluid delivery device adjacent the inner surface of the enclosure, the clip comprising:

a base; and a hook configured to support the base adjacent the inner surface of the enclosure, and a connector rotatably connecting the base and the hook, the connector comprising:

a rib protruding from the hook;

a channel formed in the base for receiving the hook; and a slit formed in the channel comprising an entrance, an exit, and an intermediate position between the entrance and the exit for receiving the rib, wherein the width of the slit decreases from the entrance to the intermediate position and increases from the intermediate position to the exit to allow relative rotation between the hook and the base about a point located near the intermediate position of the slit;

wherein rotation of the base with respect to the hook is limited.

19. The device of claim 18 wherein:

the hook comprises ratchet teeth; and the channel comprises at least one protrusion for engaging the ratchet teeth to resist sliding movement between the hook and base.

* * * * *